US010715928B2

(12) United States Patent
Wu et al.

(10) Patent No.: US 10,715,928 B2
(45) Date of Patent: Jul. 14, 2020

(54) CAPACITIVE MICROPHONE HAVING CAPABILITY OF ACCELERATION NOISE CANCELATION

(71) Applicants: Guanghua Wu, Pleasanton, CA (US); Xingshuo Lan, San Jose, CA (US); Yunlong Wang, San Ramon, CA (US)

(72) Inventors: Guanghua Wu, Pleasanton, CA (US); Xingshuo Lan, San Jose, CA (US); Yunlong Wang, San Ramon, CA (US)

(73) Assignee: GMEMS TECH SHENZHEN LIMITED, Shenzhen (CN)

( * ) Notice: Subject to any disclaimer, the term of this patent is extended or adjusted under 35 U.S.C. 154(b) by 0 days.

(21) Appl. No.: 16/270,574

(22) Filed: Feb. 7, 2019

(65) Prior Publication Data

US 2019/0174234 A1 Jun. 6, 2019

Related U.S. Application Data

(63) Continuation-in-part of application No. 15/623,339, filed on Jun. 14, 2017, now Pat. No. 10,244,330, (Continued)

(51) Int. Cl.

| | |
|---|---|
| ***H04R 19/00*** | (2006.01) |
| ***H04R 19/04*** | (2006.01) |
| ***H04R 7/18*** | (2006.01) |

(52) U.S. Cl.

CPC ..... *H04R 19/04* (2013.01); *H04R 7/18* (2013.01); *H04R 19/005* (2013.01); *H04R 2201/003* (2013.01); *H04R 2410/03* (2013.01)

(58) Field of Classification Search

CPC ..... H04R 3/005; H04R 19/005; H04R 2201/003; H04R 2410/05

See application file for complete search history.

(56) References Cited

U.S. PATENT DOCUMENTS 5,870,482 A * 2/1999 Loeppert ..... B81B 3/0072 381/174
8,351,632 B2 * 1/2013 Harney ..... H04M 1/035 381/181

(Continued)

OTHER PUBLICATIONS

Ganji et al., "Design and fabrication of a new MEMS capacitive microphone using a perforated aluminum diaphragm", Jan. 15, 2009, Sensors and Actuators A: Physical, vol. 149, Issue 1, pp. 29-37.*

(Continued)

*Primary Examiner* — Fan S Tsang
*Assistant Examiner* — Ryan Robinson
(74) *Attorney, Agent, or Firm* — Guosheng Wang; United States Research and Patent Firm

(57) ABSTRACT

The present invention provides a capacitive microphone having a capability of acceleration noise cancelation. The microphone includes (1) a moveable functional membrane comprising a basic functional membrane with an area Ao; and (2) a moveable reference membrane comprising a basic reference membrane. The basic reference membrane has one or more holes through the membrane's thickness, and the moveable reference membrane would be identical to the moveable functional membrane if the basic reference membrane does not have said one or more holes. The total area of said one or more holes is Ah, and a hole density HD is defined as Ah/Ao (%), and HD is in the range of e.g. from 0.012% to 2.647%.

19 Claims, 26 Drawing Sheets

Related U.S. Application Data which is a continuation-in-part of application No. 15/393,831, filed on Dec. 29, 2016, now Pat. No. 10,171,917.

(56) References Cited

U.S. PATENT DOCUMENTS

| | | | | |
|---|---|---|---|---|
| 9,456,284 | B2 * | 9/2016 | Morishita | H04R 19/005 |
| 9,549,252 | B2 * | 1/2017 | Suvanto | H04R 3/005 |
| 9,728,653 | B2 * | 8/2017 | Dehe | H04R 19/005 |
| 2005/0234715 | A1 * | 10/2005 | Ozawa | G10L 21/0208 704/226 |
| 2015/0208181 | A1 * | 7/2015 | Takabu | H04R 25/43 381/317 |
| 2017/0011752 | A1 * | 1/2017 | Yoo | H04R 3/005 |
| 2018/0063617 | A1 * | 3/2018 | Ohtsuka | G03B 17/08 |

OTHER PUBLICATIONS

Ganji et al., "Design and fabrication of a new MEMS capacitive microphone using a perforated aluminum diaphragm", Jan. 15, 2009, Sensors and Actuators A: Physical, vol. 149, Issue 1, pp. 29-37 (Year: 2009).*

* cited by examiner

CAPACITIVE MICROPHONE HAVING CAPABILITY OF ACCELERATION NOISE CANCELATION

CROSS-REFERENCE TO RELATED U.S. APPLICATIONS

This application is a Continuation-in-Part of U.S. non-provisional application Ser. No. 15/623,339 filed on Jun. 14, 2017, which is a Continuation-in-Part of U.S. non-provisional application Ser. No. 15/393,831 filed on Dec. 29, 2016 and patented as U.S. Pat. No. 10,171,917 on Jan. 1, 2019, the contents of which two prior applications are incorporated herein by reference in its entirety.

FIELD OF THE INVENTION

The present invention generally relates to a capacitive microphone having a capability of acceleration noise cancelation. The microphone of the invention may find applications in smart phones, telephones, hearing aids, public address systems for concert halls and public events, motion picture production, live and recorded audio engineering, two-way radios, megaphones, radio and television broadcasting, and in computers for recording voice, speech recognition, VoIP, and for non-acoustic purposes such as ultrasonic sensors or knock sensors, among others.

BACKGROUND OF THE INVENTION

A capacitance microphone converts acoustic signal to its mechanical vibration, and further converts to a capacitance signal. FIG. 1A is a schematic diagram of parallel capacitive microphone in the prior art. Two thin layers 101 and 102 are placed closely in almost parallel. One of them is fixed backplate 101, and the other one is movable/deflectable membrane/diaphragm 102, which can be moved or driven by sound pressure. Diaphragm 102 acts as one plate of a capacitor, and the vibrations thereof produce changes in the distance between two layers 101 and 102, and changes in the mutual capacitance therebetween.

"Squeeze film" and "squeezed film" refer to a type of hydraulic or pneumatic damper for damping vibratory motion of a moving component with respect to a fixed component. Squeezed film damping occurs when the moving component is moving perpendicular and in close proximity to the surface of the fixed component (e.g., between approximately 2 and 50 micrometers). The squeezed film effect results from compressing and expanding the fluid (e.g., a gas or liquid) trapped in the space between the moving plate and the solid surface. The fluid has a high resistance, and damps the motion of the moving component as the fluid flows through the space between the moving plate and the solid surface.

In capacitive microphones as shown in FIG. 1A, squeeze film damping occurs when two layers 101 and 102 are in close proximity to each other with air disposed between them. The layers 101 and 102 are positioned so close together (e.g. within 5 μm) that air can be "squeezed" and "stretched" to slow movement of membrane/diaphragm 102. As the gap between layers 101 and 102 shrinks, air must flow out of that region. The flow viscosity of air, therefore, gives rise to a force that resists the motion of moving membrane/diaphragm 101. Squeeze film damping is significant when membrane/diaphragm 101 has a large surface area to gap length ratio. Such squeeze film damping between the two layers 101 and 102 becomes a mechanical noise source, which is the dominating factor among all noise sources in the entire microphone structure.

Co-pending U.S. application Ser. No. 15/393,831 to the same assignee, which is incorporated herein by reference, teaches a so-called lateral mode microphone in which the movable membrane/diaphragm does not move into the fixed backplate, and the squeeze film damping is substantially avoided. An embodiment of the lateral mode microphone is shown in FIG. 1B. First electrical conductor 201 is stationary, and has a function similar to the fixed backplate in the prior art. A large flat area of second electrical conductor 202, similar to movable/deflectable membrane/diaphragm 102 in FIG. 1A, receives acoustic pressure and moves up and down along the primary direction, which is perpendicular to the flat area. However, conductors 201 and 202 are configured in a side-by-side spatial relationship, not one above another. As one "plate" of the capacitor, conductor 202 does not move toward and from conductor 201. Instead, conductor 202 laterally moves over, or "glides" over, conductor 201, producing changes in the overlapped area between 201 and 202, and therefore varying the mutual capacitance therebetween. A capacitive microphone based on such a relative movement between conductors 201 and 202 is called lateral mode capacitive microphone.

However, such a lateral mode capacitive microphone suffers a problem. An acceleration of the microphone may affect the accuracy of sound detection. An acceleration of 1G on the direction that is normal to the flat area of conductor 202 (or membrane 202) causes a signal to be detected, whose value may be 13% of 1 Pa sound pressure. Signal to Acceleration Ratio (SAR) may be used to define this effect. For example, the SAR for a single slot design structure disclosed in the co-pending U.S. application Ser. No. 15/393,831 can be around 7.6, which is much smaller than the typical SAR 70-100 for a conventional MEMS microphone. A microphone with low SAR will suffer from inaccurate signal detection when the microphone vibrates at low frequency. For example, if the microphone, or a device using such a microphone (e.g. a cellphone), is being used in a running automobile, the shake or vibration of the device along the automobile is actually an acceleration applied on membrane 202 and may be "misread" as a sound signal.

Co-pending U.S. application Ser. No. 15/623,339 to the same assignee, which is incorporated herein by reference, provides an improved lateral mode capacitive microphone, in which the low SAR effect is compensated. Co-pending U.S. application Ser. No. 15/623,339 teaches a motional sensor is used in the microphone to estimate the noise introduced from acceleration or vibration of the microphone for the purpose of compensating the microphone output through a signal subtraction operation. In an embodiment, the motional sensor is identical to the lateral microphone, except that the movable membrane in the motional sensor has air ventilation holes for lowering the movable membrane's air resistance, and making the movable membrane responsive only to acceleration or vibration of the microphone.

However, random air ventilation holes will not have the most desired SAR compensation. Advantageously, the present invention provides a solution to such a problem.

SUMMARY OF THE INVENTION

The present invention provides a capacitive microphone having a capability of acceleration noise cancelation. The microphone includes (1) a moveable functional membrane comprising a basic functional membrane with an area Ao;

and (2) a moveable reference membrane comprising a basic reference membrane. The basic reference membrane has one or more holes through the membrane's thickness, and the moveable reference membrane would be identical to the moveable functional membrane if the basic reference membrane does not have said one or more holes.

In various embodiments, the present invention utilizes a reference moving membrane that can detect the acceleration signal. The measured acceleration signal can then be used to cancel out the component of actual acceleration signal in the total ("gross") signal as measured by the lateral microphone in real-time, through a signal subtraction operation.

The above features and advantages and other features and advantages of the present invention are readily apparent from the following detailed description of the best modes for carrying out the invention when taken in connection with the accompanying drawings.

BRIEF DESCRIPTION OF THE SEVERAL VIEWS OF THE DRAWINGS

The present invention is illustrated by way of example, and not by way of limitation, in the figures of the accompanying drawings and in which like reference numerals refer to similar elements. All the figures are schematic and generally only show parts which are necessary in order to elucidate the invention. For simplicity and clarity of illustration, elements shown in the figures and discussed below have not necessarily been drawn to scale. Well-known structures and devices are shown in simplified form in order to avoid unnecessarily obscuring the present invention. Other parts may be omitted or merely suggested.

DETAILED DESCRIPTION OF THE PREFERRED EMBODIMENT

In the following description, for the purposes of explanation, numerous specific details are set forth in order to provide a thorough understanding of the present invention. It is apparent, however, to one skilled in the art that the present invention may be practiced without these specific details or with an equivalent arrangement.

Where a numerical range is disclosed herein, unless otherwise specified, such range is continuous, inclusive of both the minimum and maximum values of the range as well as every value between such minimum and maximum values. Still further, where a range refers to integers, only the integers from the minimum value to and including the maximum value of such range are included. In addition, where multiple ranges are provided to describe a feature or characteristic, such ranges can be combined.

Figure 2:
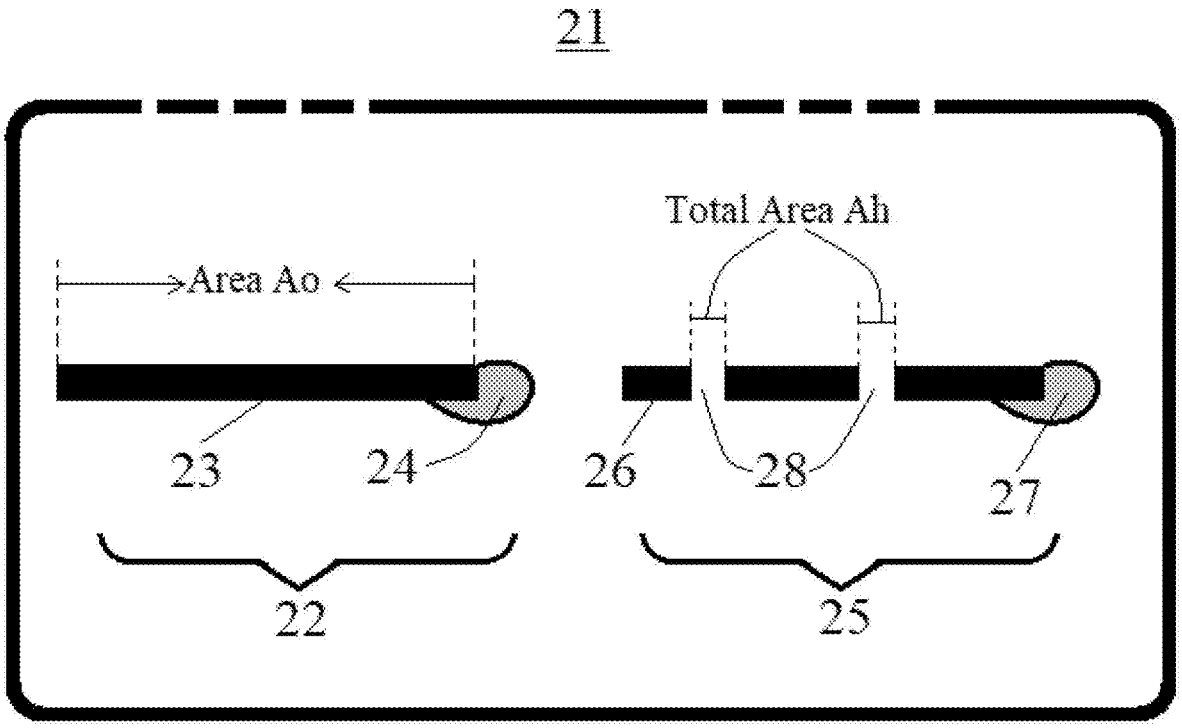
FIG. 2 schematically illustrates a capacitive microphone 21 having a capability of acceleration noise cancelation in an embodiment of the invention.

FIG. 2 schematically illustrates a capacitive microphone 21 having a capability of acceleration noise cancelation in an embodiment of the invention. The microphone 21 includes a moveable functional membrane 22 and a moveable reference membrane 25. The moveable functional membrane 22 comprises a basic functional membrane 23 with a mass of Mo>0 and an area of Ao square meters ($m^2$). Optionally, the moveable functional membrane 22 further comprises one or more additional parts 24 that are attached to, and moveable along with, the basic functional membrane 23. The total mass of the one or more additional parts is Ma≥0. Similarly, the moveable reference membrane 25 includes a basic reference membrane 26, and one or more additional parts 27 that are attached to, and moveable along with, the basic reference membrane 26. However, the basic reference membrane 26 has one or more holes 28 through the membrane's thickness. The moveable reference membrane 25 would be identical to the moveable functional membrane 22 if the basic reference membrane 26 does not have said one or more holes 28. The total area of said one or more holes 28 is Ah, and a hole density HD is defined as Ah/Ao (%), and HD can be of any value, for example, it can be in the range of from 0.012% to 2.647%. The total area that is removed from the area of a membrane to form, make or "perforate" said one or more holes 28 on the membrane is defined as total area Ah of said one or more holes 28.

Figure 1A:
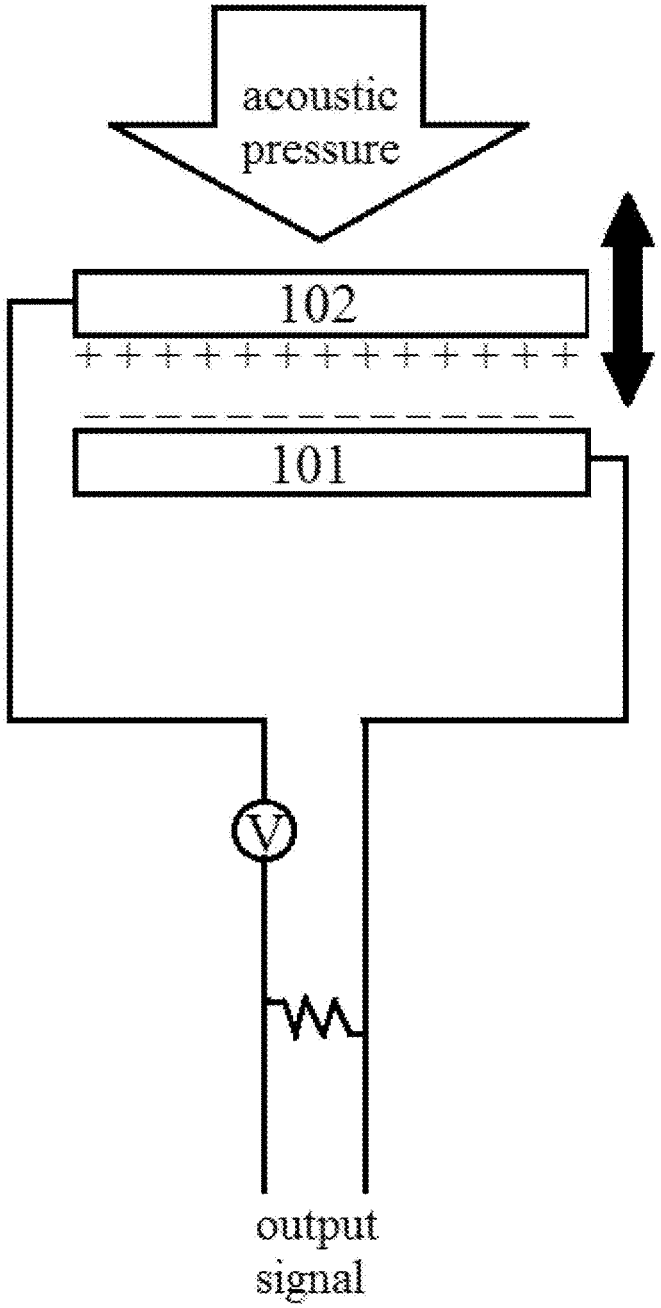
(Prior Art) Figure 1A
FIG. 1A shows a conventional capacitive microphone in the prior art.
Figure 3:
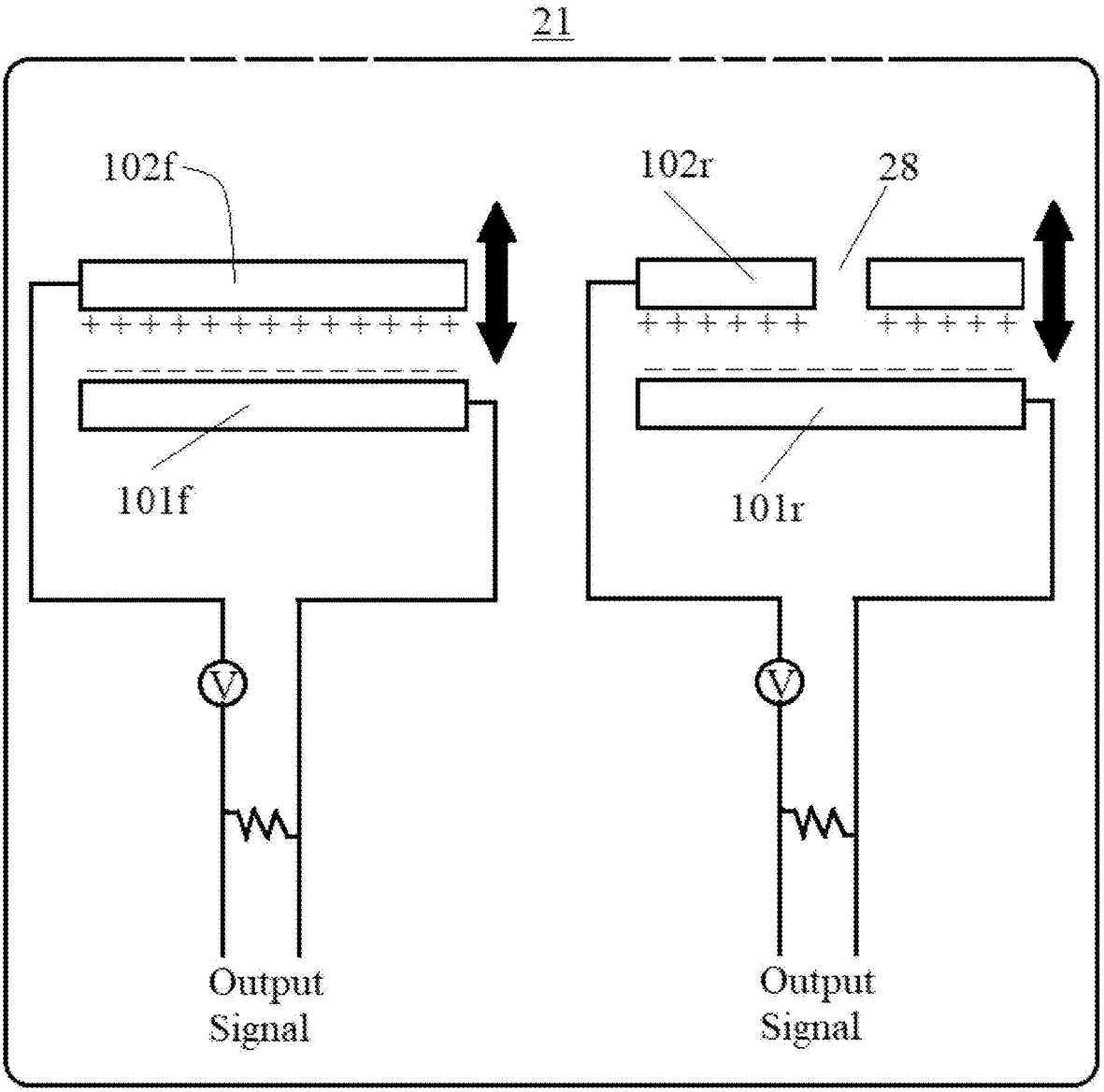
FIG. 3 is a schematic diagram of a parallel capacitive microphone having a capability of acceleration noise cancelation according to an embodiment of the invention.

FIG. 3 is a schematic diagram of a parallel capacitive microphone that is modified from FIG. 1A microphone according to an embodiment of the invention. Two thin functional layers 101*f* and 102*f* are placed closely in almost parallel. One of them is fixed backplate 101*f*, and the other one is movable/deflectable membrane/diaphragm 102*f* (an embodiment of moveable functional membrane 22 in FIG. 2), which can be moved or driven by sound pressure. Diaphragm 102*f* acts as one plate of a capacitor, and the vibrations thereof produce changes in the distance between two layers 101*f* and 102*f*, and changes in the mutual capacitance therebetween. On the other hand, two thin reference layers 101*r* and 102*r* are placed closely in almost parallel. One of them is fixed backplate 101*r*, and the other one is movable/deflectable membrane/diaphragm 102*r* (an embodiment of moveable reference membrane 25 in FIG. 2), which can be moved or driven by sound pressure. There are one or more holes 28 on diagram 102*r*. Diaphragm 102*r* acts as one plate of a capacitor, and the vibrations thereof produce changes in the distance between two layers 101*r* and 102*r*, and changes in the mutual capacitance therebetween. The HD of the parallel capacitive microphone as shown in FIG. 3 is in the range of e.g. from 0.012% to 2.647%.

Figure 1B:
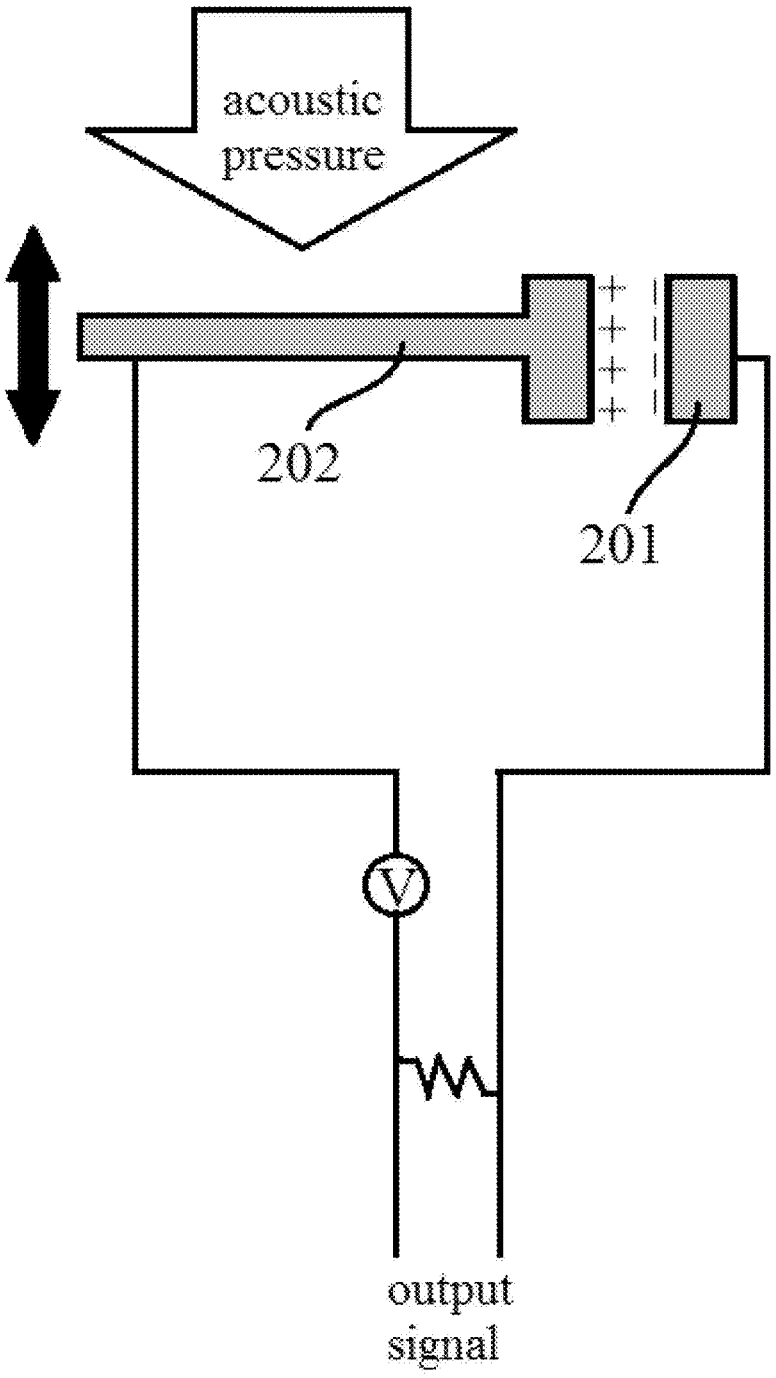
FIG. 1B illustrates a lateral mode capacitive microphone in a co-pending U.S. application filed by the same Applicants.
Figure 4:
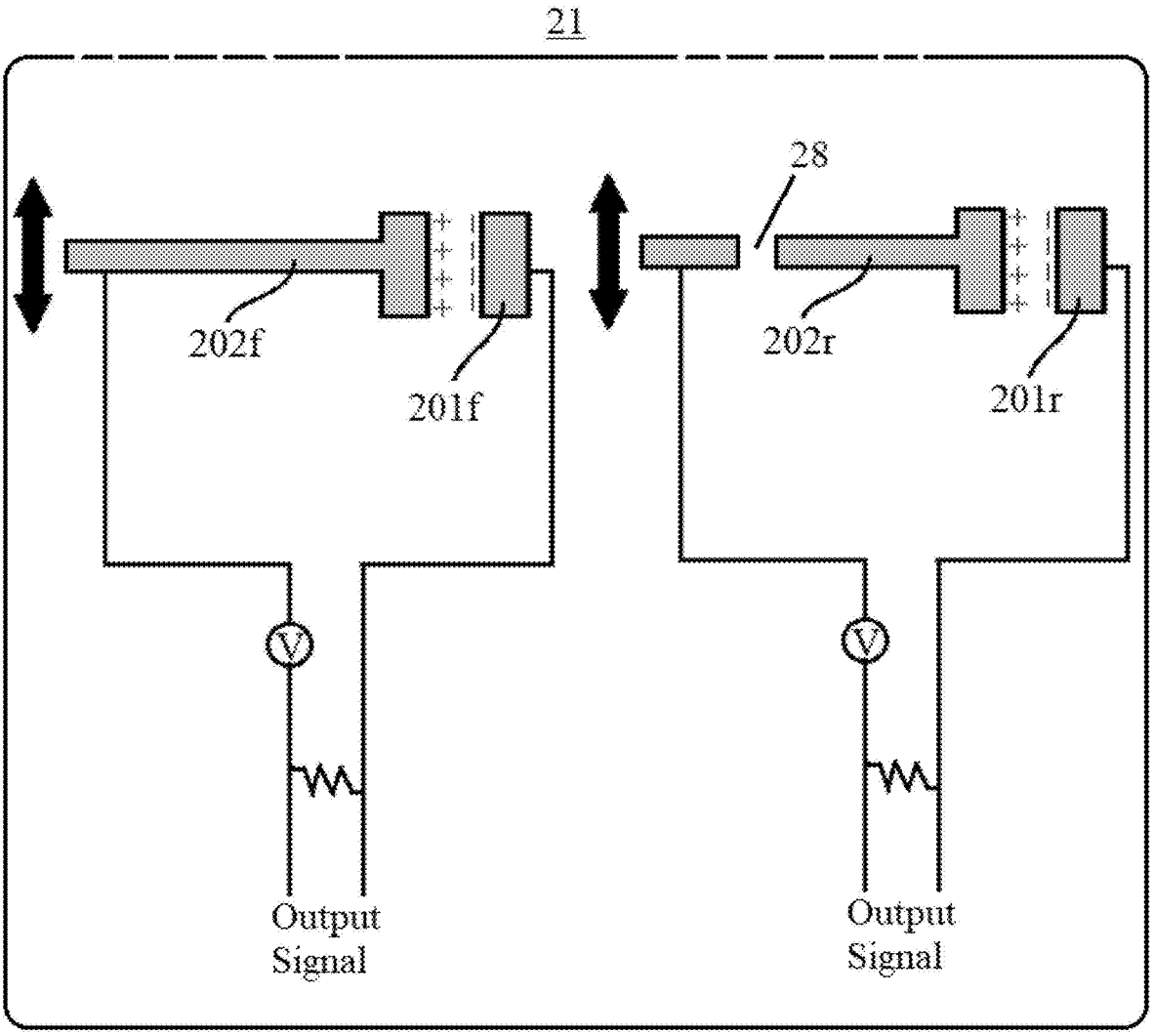
FIG. 4 is a schematic diagram of a lateral mode microphone having a capability of acceleration noise cancelation according to an embodiment of the invention.

FIG. 4 is a schematic diagram of a lateral mode microphone that is modified from FIG. 1B microphone according to an embodiment of the invention. First functional electrical conductor 201*f* is stationary, and has a function similar to the fixed backplate 101*f* in FIG. 3. A large flat area of second functional electrical conductor 202*f* (an embodiment of moveable reference membrane 22 in FIG. 2), similar to movable/deflectable membrane/diaphragm 102*f* in FIG. 3, receives acoustic pressure and moves up and down. Conductors 201*f* and 202*f* are configured in a side-by-side spatial relationship, not one above another. As one "plate" of the capacitor, conductor 202*f* does not move toward and from conductor 201*f*. Instead, conductor 202*f* laterally moves over, or "glides" over, conductor 201*f*, producing changes in the overlapped area between 201*f* and 202*f*, and therefore varying the mutual capacitance therebetween. Similarly, first reference electrical conductor 201*r* is stationary, and has a function similar to the fixed backplate 101*r* in FIG. 3. A large flat area of second reference electrical conductor 202*r* (an embodiment of moveable reference membrane 25 in FIG. 2), similar to movable/deflectable membrane/diaphragm 102*r* in FIG. 3, receives acoustic pressure and moves up and down. Conductors 201*r* and 202*r* are configured in a side-by-side spatial relationship, not one above another. As one "plate" of the capacitor, conductor 202*r* does not move toward and from conductor 201*r*. Instead, conductor 202*r* laterally moves over, or "glides" over, conductor 201*r*, producing changes in the overlapped area between 201*r* and 202*r*, and therefore varying the mutual capacitance therebetween. There are one or more holes 28 on conductor 202*r*, and the HD of the lateral mode microphone as shown in FIG. 4 is in the range of e.g. from 0.012% to 2.647%.

Without being bound by any particular theory or model, the present invention provides a mechanism of acceleration noise cancelation in MEMS capacitance microphone. A concept SAR (signal acceleration ratio) is used to measure how the effect of acceleration noise cancellation is. Then an Electro-Acoustic model is built to find the optimized hole density of cancelation structure, which indicates a few important factors that are related to the optimized hole density. Eventually, a conclusion of optimized hole density is addressed through linear approach. It has been discovered that, when HD is in a range of e.g. from 0.012% to 2.647% or a subrange thereof, the corresponding SAR values are at least 10%, 20%, 30%, 50%, 100%, 200%, or 300% higher than those SAR values when HD exceeds the range. For example, SAR values of the microphones according to the present invention may be at least 500, 1000, 2000, 3000, 6000, 9000, 12000, 15000, 24000 or even higher.

In order to minimize the effect of acceleration noise, a cancellation approach including two (or more) structures can be used at same time. One structure is a functional microphone (e.g. that including a moveable functional membrane 22 as shown in FIG. 2) that converts both sound signal and acceleration to capacitance signal. The other one (e.g. that including a moveable reference membrane 25 as shown in FIG. 2) converts essentially only acceleration signal. Through a minus operation between the signals from these two (or more) structures or "microphones", the acceleration signal is cancelled out and the sound signal is maintained.

Figure 5:
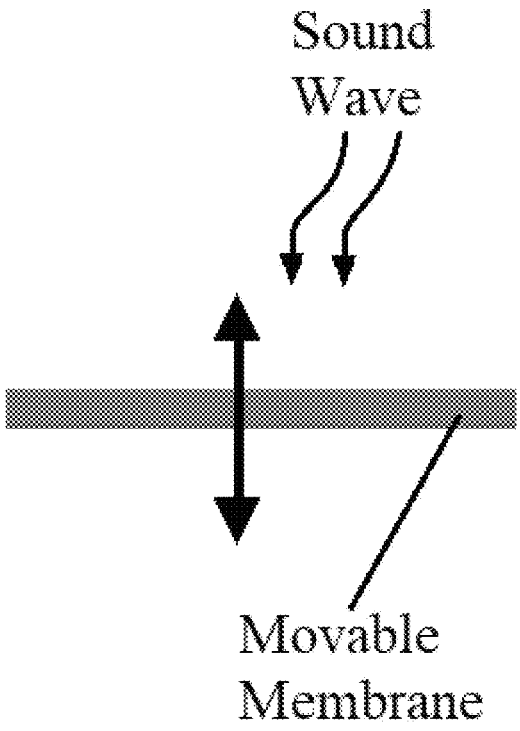
FIG. 5 shows a membrane deflects or vibrates under an acoustic pressure in sound wave and thus changes the capacitance it forms with another electrode in accordance with an exemplary embodiment of the present invention.

As shown in FIG. 5, an important part in capacitance microphone structure is membrane (or called diaphragm). A membrane can deflect or vibrate along a certain direction. It could be driven by acoustic pressure in sound wave and thus changes the capacitance it forms with another electrode. An approach to make membrane not convert acoustic signal is opening holes on it, since most energy in sound wave passes through membrane by these opening holes. This membrane with holes can be used as a reference membrane to cancel out acceleration noise. Therefore, to minimize the acceleration noise, at least two membranes are needed by this approach. One is normal and functional membrane, the other one is reference membrane with opening holes.

In typical embodiments of the invention, a reference membrane does not give exactly the same acceleration noise signal as a functional membrane because of the mass loss due to those opening holes. The more holes that are opened on the membrane, the less mass the membrane has. Less mass typically results in less deflection under acceleration. If there is too much mass loss, the acceleration noise cannot be compensating effectively. On the other hand, if there is only a few holes or the size of opening holes are too small, sound wave will still partially hit on the reference membrane and then cause a mechanical vibration, which weakens the desired sound signal after the minus operation. Therefore, it is a tradeoff between mass loss and weakened sound signal. There must be an optimized point where the noise compensation works most effectively.

Without being bound by any particular theory or model, a concept SAR (signal acceleration ratio) is defined as the ratio of the sound signal under 1 Pa sound pressure to the acceleration signal from 1 gravity (1 g) acceleration. For a capacitance microphone, signal comes from the capacitance change, which further comes from the change of membrane deflection. Thus SAR can also be expressed by SAR=Da/Dg, wherein Da is the amplitude of membrane vibration caused by 1 Pa pressure acoustic wave, and Dg is the membrane deflection caused by 1 g acceleration. For the membrane with opening holes, different hole density defines different SAR after compensation, which represents the effectiveness of acceleration noise cancelation.

Figure 6:
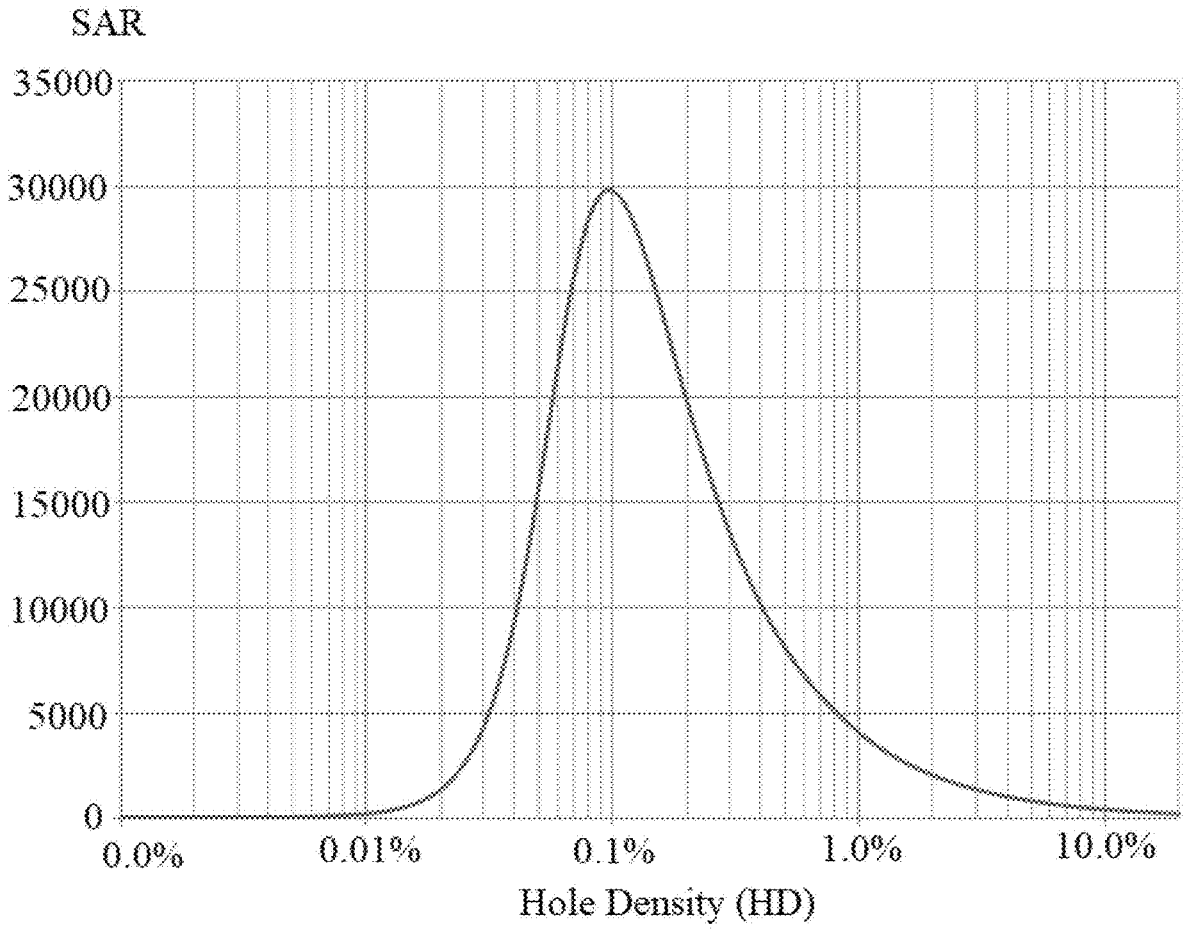
FIG. 6 shows a plot demonstrating the relationship between SAR and Hole Density (HD) on a reference membrane in accordance with an exemplary embodiment of the present invention.

Without being bound by any particular theory or model, an electro-acoustic model is used to study SAR performance of this acceleration noise compensation approach under different conditions. With this electro-acoustic model, a plot demonstrating the relationship between SAR and Hole Density (HD) on a reference membrane is shown in FIG. 6. It can be found a peak where SAR reaches its maximum value. When opening holes on reference membrane occupy around 0.1% of the total membrane area, the SAR value is the highest. Three general factors that help to build the model may be set as default parameters in the model. One is the resonance frequency of the functional membrane, which may be e.g. 30, 40 or 50 kHz. The second one is the volume of microphone chamber, which may be a typical microphone product on market e.g. 3.7 mm×2.9 mm×0.9 mm, 2.7 mm×1.8 mm×0.9 mm, or 3.7 mm×2.2 mm×0.9 mm. The third one is the number of holes, which may be set as 4, 6 or 12. With that, two more factors are also studied through the model, which are area of Ao and ratio of Ma/Mo, as described above and referring to FIG. 2. It has been discovered that, when Ao becomes bigger, the maximum SAR value also goes higher, and the optimized hole density becomes lower. It has also been discovered that, when ratio Ma/Mo becomes bigger, the maximum SAR value also goes higher, and the optimized hole density becomes slightly lower. Based on tabulated parameters, a group of multi-factor linear approach is made to derive a mathematical expression.

Figure 7:
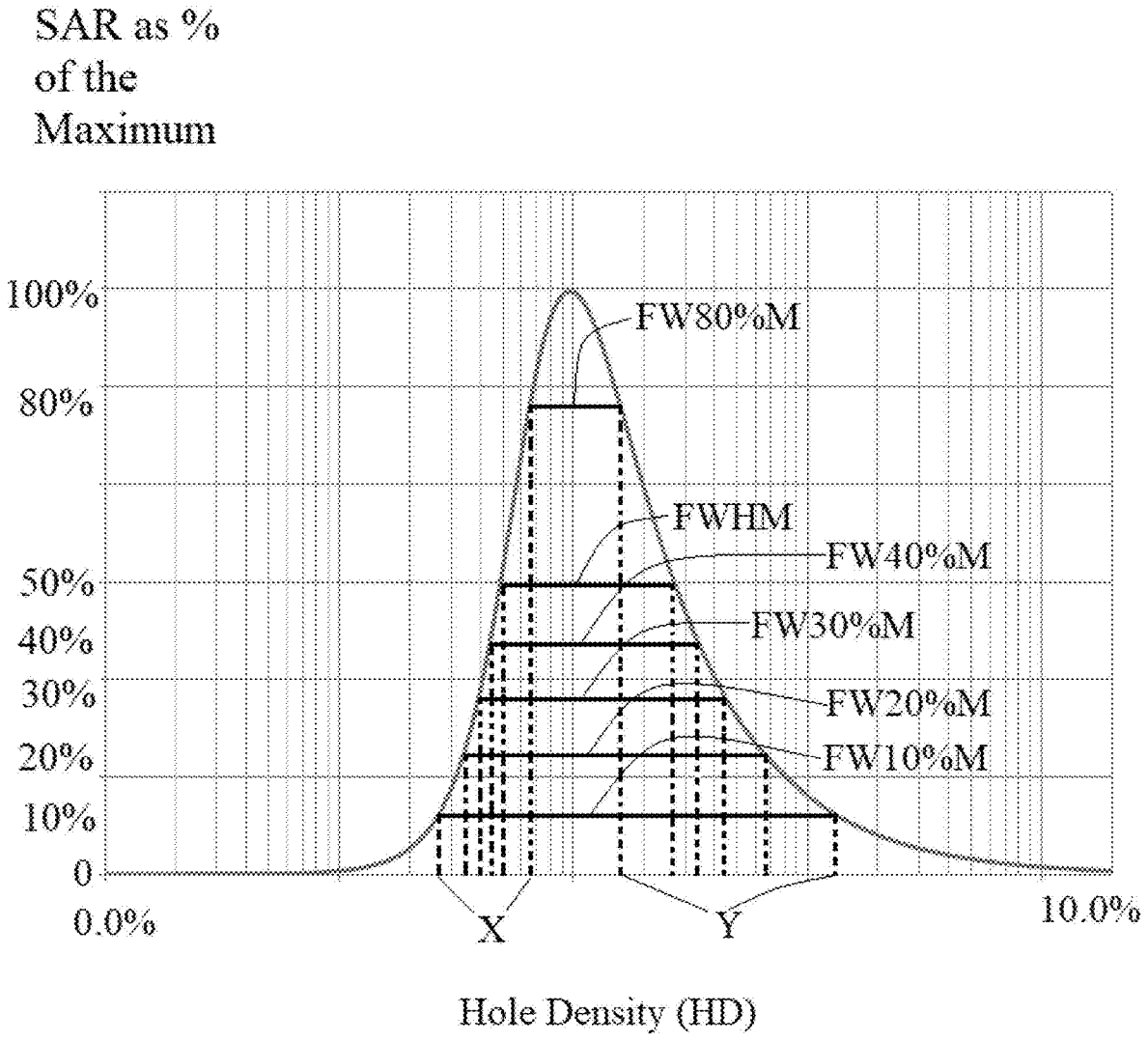
FIG. 7 shows a representative plot demonstrating the relationship between SAR and Hole Density (HD) on a reference membrane in accordance with an exemplary embodiment of the present invention.

FIG. 7 shows a representative plot demonstrating the relationship between SAR and Hole Density (HD) on a reference membrane. Referring back to FIG. 2, the moveable functional membrane 22 comprises a basic functional membrane 23 with a mass of Mo>0 and an area of Ao square meters ($m^2$), as well as one or more additional parts 24 that are attached to, and moveable along with, the basic functional membrane 23. The total mass of the one or more additional parts is Ma≥0. The moveable reference membrane 25 would be identical to the moveable functional membrane 22 if the basic reference membrane 26 does not have said one or more holes 28. The total area of said one or more holes 28 is Ah, and a hole density HD is defined as Ah/Ao (%), and HD is generally in the range of e.g. from 0.012% to 2.647%.

In an embodiment of the invention as shown in FIG. 7, the hole density HD range is the Full Width at 10% Maximum (FW10%M). The definition of "FW10%M" is similar to the definition of "FWHM" as known to a skilled person in the art. Full Width at Half Maximum (FWHM), or Full Width at 50% Maximum (FW50%M), is an expression of the extent of function given by the difference between the two extreme values of the independent variable (e.g. HD=X and HD=Y in FIG. 7) at which the dependent variable (e.g. SAR in FIG. 7) is equal to half or 50% of its maximum value. In other words, it is the width of a spectrum curve measured between those points on the y-axis which are half the maximum or 50% amplitude. The "FW10%M" is an expression of the extent of function given by the difference between the two extreme values of the independent variable (e.g. HD=X and HD=Y in FIG. 7) at which the dependent variable (e.g. SAR in FIG. 7) is equal to 10% of its maximum value. In other words, FW10%M is the width of a spectrum curve measured between those points on the y-axis which are 10% of the maximum or amplitude. The definitions of "FW20%M", "FW30%M", "FW40%M", and "FW80%M" etc. are, mutatis mutandis, similar to "FW10%M", and will be omitted for conciseness. The "FW10%M" is in the range of from X to Y, X is from 0.012% to 0.046%, and Y is from to 0.602% to 2.647%. In an embodiment, X and Y satisfy the following equations:

$$X=(-4.95\times10^{-5})+(2.57\times10^{-6})(Ao)^{-1/3}+(-9.44\times10^{-5})(Ma/Mo)^{2/3};\text{ and}$$

$$Y=(-5.93\times10^{-3})+(1.62\times10^{-4})(Ao)^{-1/3}+(-4.71\times10^{-3})(Ma/Mo)^{2/3}.$$

The following table lists some exemplary values of Ao ($m^2$), Ma/Mo, and the Full Width at 10% Maximum:

| | | Full Width at 10% Maximum | |
|---|---|---|---|
| Ao ($m^2$) | Ma/Mo | X | Y |
| $1.26\times10^{-7}$ | 0 | 0.046% | 2.647% |
| $1.96\times10^{-7}$ | 0 | 0.039% | 2.200% |
| $2.83\times10^{-7}$ | 0 | 0.034% | 1.880% |
| $3.85\times10^{-7}$ | 0 | 0.030% | 1.638% |
| $5.03\times10^{-7}$ | 0 | 0.027% | 1.448% |
| $6.36\times10^{-7}$ | 0 | 0.025% | 1.294% |
| $7.85\times10^{-7}$ | 0 | 0.023% | 1.166% |
| $1.26\times10^{-7}$ | 0.5 | 0.039% | 2.301% |
| $2.83\times10^{-7}$ | 0.5 | 0.027% | 1.534% |
| $5.03\times10^{-7}$ | 0.5 | 0.020% | 1.102% |
| $7.85\times10^{-7}$ | 0.5 | 0.016% | 0.820% |
| $1.26\times10^{-7}$ | 1 | 0.037% | 2.176% |
| $2.83\times10^{-7}$ | 1 | 0.025% | 1.409% |
| $5.03\times10^{-7}$ | 1 | 0.018% | 0.977% |
| $7.85\times10^{-7}$ | 1 | 0.013% | 0.695% |
| $1.26\times10^{-7}$ | 1.5 | 0.035% | 2.083% |
| $2.83\times10^{-7}$ | 1.5 | 0.023% | 1.316% |
| $5.03\times10^{-7}$ | 1.5 | 0.016% | 0.884% |
| $7.85\times10^{-7}$ | 1.5 | 0.012% | 0.602% |

In an embodiment of the invention as shown in FIG. 7, the hole density HD range is the Full Width at 20% Maximum (FW20%M). The "FW20%M" is in the range of from X to Y, X is from 0.015% to 0.059%, and Y is from to 0.303% to 1.322%. In an embodiment, X and Y satisfy the following equations:

$$X=(-6.47\times10^{-5})+(3.30\times10^{-6})(Ao)^{-1/3}+(-1.21\times10^{-4})(Ma/Mo)^{2/3};\text{ and}$$

$$Y=(-2.91\times10^{-3})+(8.08\times10^{-5})(Ao)^{-1/3}+(-2.35\times10^{-3})(Ma/Mo)^{2/3}.$$

The following table lists some exemplary values of Ao ($m^2$), Ma/Mo, and the Full Width at 20% Maximum:

| Ao ($m^2$) | Ma/Mo | Full Width at 20% Maximum X | Y |
|---|---|---|---|
| $1.26 \times 10^{-7}$ | 0 | 0.059% | 1.322% |
| $1.96 \times 10^{-7}$ | 0 | 0.050% | 1.099% |
| $2.83 \times 10^{-7}$ | 0 | 0.044% | 0.940% |
| $3.85 \times 10^{-7}$ | 0 | 0.039% | 0.820% |
| $5.03 \times 10^{-7}$ | 0 | 0.035% | 0.725% |
| $6.36 \times 10^{-7}$ | 0 | 0.032% | 0.649% |
| $7.85 \times 10^{-7}$ | 0 | 0.029% | 0.585% |
| $1.26 \times 10^{-7}$ | 0.5 | 0.051% | 1.149% |
| $2.83 \times 10^{-7}$ | 0.5 | 0.035% | 0.767% |
| $5.03 \times 10^{-7}$ | 0.5 | 0.026% | 0.552% |
| $7.85 \times 10^{-7}$ | 0.5 | 0.020% | 0.412% |
| $1.26 \times 10^{-7}$ | 1 | 0.047% | 1.087% |
| $2.83 \times 10^{-7}$ | 1 | 0.032% | 0.705% |
| $5.03 \times 10^{-7}$ | 1 | 0.023% | 0.490% |
| $7.85 \times 10^{-7}$ | 1 | 0.017% | 0.349% |
| $1.26 \times 10^{-7}$ | 1.5 | 0.045% | 1.041% |
| $2.83 \times 10^{-7}$ | 1.5 | 0.029% | 0.658% |
| $5.03 \times 10^{-7}$ | 1.5 | 0.021% | 0.443% |
| $7.85 \times 10^{-7}$ | 1.5 | 0.015% | 0.303% |

In an embodiment of the invention as shown in FIG. 7, the hole density HD range is the Full Width at 30% Maximum (FW30%M), i.e. in the range of from X to Y, X is from 0.017% to 0.069%, and Y is from to 0.199% to 0.88%. In an embodiment, X and Y satisfy the following equations:

$$X=(-7.64\times10^{-5})+(3.86\times10^{-6})(Ao)^{-1/3}+(-1.41\times10^{-4})(Ma/Mo)^{2/3};\text{ and}$$

$$Y=(-1.98\times10^{-3})+(5.40\times10^{-5})(Ao)^{-1/3}+(-1.57\times10^{-3})(Ma/Mo)^{2/3}.$$

The following table lists some exemplary values of Ao ($m^2$), Ma/Mo, and the Full Width at 30% Maximum:

| Ao ($m^2$) | Ma/Mo | Full Width at 30% Maximum X | Y |
|---|---|---|---|
| $1.26 \times 10^{-7}$ | 0 | 0.069% | 0.880% |
| $1.96 \times 10^{-7}$ | 0 | 0.059% | 0.731% |
| $2.83 \times 10^{-7}$ | 0 | 0.051% | 0.625% |
| $3.85 \times 10^{-7}$ | 0 | 0.045% | 0.544% |
| $5.03 \times 10^{-7}$ | 0 | 0.041% | 0.481% |
| $6.36 \times 10^{-7}$ | 0 | 0.037% | 0.430% |
| $7.85 \times 10^{-7}$ | 0 | 0.034% | 0.387% |
| $1.26 \times 10^{-7}$ | 0.5 | 0.059% | 0.764% |
| $2.83 \times 10^{-7}$ | 0.5 | 0.041% | 0.509% |
| $5.03 \times 10^{-7}$ | 0.5 | 0.031% | 0.366% |
| $7.85 \times 10^{-7}$ | 0.5 | 0.024% | 0.272% |
| $1.26 \times 10^{-7}$ | 1 | 0.055% | 0.723% |
| $2.83 \times 10^{-7}$ | 1 | 0.037% | 0.468% |
| $5.03 \times 10^{-7}$ | 1 | 0.027% | 0.324% |
| $7.85 \times 10^{-7}$ | 1 | 0.020% | 0.230% |
| $1.26 \times 10^{-7}$ | 1.5 | 0.052% | 0.692% |
| $2.83 \times 10^{-7}$ | 1.5 | 0.034% | 0.437% |
| $5.03 \times 10^{-7}$ | 1.5 | 0.024% | 0.293% |
| $7.85 \times 10^{-7}$ | 1.5 | 0.017% | 0.199% |

In an embodiment of the invention as shown in FIG. 7, the hole density HD range is the Full Width at 40% Maximum (FW40%M), i.e. in the range of from X to Y, X is from 0.019% to 0.078%, Y is from to 0.152% to 0.655%. In an embodiment, X and Y satisfy the following equations:

$$X=(-8.65\times10-^{-5})+(4.35\times10^{-6})(Ao)^{-1/3}+(-1.59\times10^{-4})(Ma/Mo)^{2/3};\text{ and}$$

$$Y=(-1.37\times10^{-3})+(3.96\times10^{-5})(Ao)^{-1/3}+(-1.18\times10^{-3})(Ma/Mo)^{2/3}.$$

The following table lists some exemplary values of Ao ($m^2$), Ma/Mo, and the Full Width at 40% Maximum:

| Ao ($m^2$) | Ma/Mo | Full Width at 40% Maximum X | Y |
|---|---|---|---|
| $1.26 \times 10^{-7}$ | 0 | 0.078% | 0.655% |
| $1.96 \times 10^{-7}$ | 0 | 0.066% | 0.545% |
| $2.83 \times 10^{-7}$ | 0 | 0.058% | 0.467% |
| $3.85 \times 10^{-7}$ | 0 | 0.051% | 0.408% |
| $5.03 \times 10^{-7}$ | 0 | 0.046% | 0.362% |
| $6.36 \times 10^{-7}$ | 0 | 0.042% | 0.324% |
| $7.85 \times 10^{-7}$ | 0 | 0.038% | 0.293% |
| $1.26 \times 10^{-7}$ | 0.5 | 0.066% | 0.568% |
| $2.83 \times 10^{-7}$ | 0.5 | 0.046% | 0.381% |
| $5.03 \times 10^{-7}$ | 0.5 | 0.034% | 0.275% |
| $7.85 \times 10^{-7}$ | 0.5 | 0.027% | 0.206% |
| $1.26 \times 10^{-7}$ | 1 | 0.062% | 0.537% |
| $2.83 \times 10^{-7}$ | 1 | 0.042% | 0.350% |
| $5.03 \times 10^{-7}$ | 1 | 0.030% | 0.244% |
| $7.85 \times 10^{-7}$ | 1 | 0.023% | 0.175% |
| $1.26 \times 10^{-7}$ | 1.5 | 0.059% | 0.514% |
| $2.83 \times 10^{-7}$ | 1.5 | 0.039% | 0.326% |
| $5.03 \times 10^{-7}$ | 1.5 | 0.027% | 0.221% |
| $7.85 \times 10^{-7}$ | 1.5 | 0.019% | 0.152% |

In an embodiment of the invention as shown in FIG. 7, the hole density HD range is the Full Width at 50% Maximum (FW50%M, or FWHM), i.e. in the range of from X to Y, X is from 0.021% to 0.086%, and Y is from to 0.119% to 0.52%. In an embodiment, X and Y satisfy the following equations:

$$X=(-9.53\times10^{-5})+(4.81\times10^{-6})(Ao)^{-1/3}+(-1.76\times10^{-4})(Ma/Mo)^{2/3};\text{ and}$$

$$Y=(-1.09\times10^{-3})+(3.15\times10^{-5})(Ao)^{-1/3}+(-9.47\times10^{-4})(Ma/Mo)^{2/3}.$$

The following table lists some exemplary values of Ao ($m^2$), Ma/Mo, and the Full Width at 50% Maximum:

| Ao ($m^2$) | Ma/Mo | Full Width at Half Maximum X | Y |
|---|---|---|---|
| $1.26 \times 10^{-7}$ | 0 | 0.086% | 0.520% |
| $1.96 \times 10^{-7}$ | 0 | 0.073% | 0.433% |
| $2.83 \times 10^{-7}$ | 0 | 0.064% | 0.371% |
| $3.85 \times 10^{-7}$ | 0 | 0.057% | 0.324% |
| $5.03 \times 10^{-7}$ | 0 | 0.051% | 0.288% |
| $6.36 \times 10^{-7}$ | 0 | 0.046% | 0.258% |
| $7.85 \times 10^{-7}$ | 0 | 0.043% | 0.233% |
| $1.26 \times 10^{-7}$ | 0.5 | 0.074% | 0.451% |
| $2.83 \times 10^{-7}$ | 0.5 | 0.051% | 0.302% |
| $5.03 \times 10^{-7}$ | 0.5 | 0.038% | 0.218% |
| $7.85 \times 10^{-7}$ | 0.5 | 0.030% | 0.163% |
| $1.26 \times 10^{-7}$ | 1 | 0.069% | 0.426% |
| $2.83 \times 10^{-7}$ | 1 | 0.046% | 0.277% |
| $5.03 \times 10^{-7}$ | 1 | 0.033% | 0.193% |
| $7.85 \times 10^{-7}$ | 1 | 0.025% | 0.138% |
| $1.26 \times 10^{-7}$ | 1.5 | 0.065% | 0.407% |
| $2.83 \times 10^{-7}$ | 1.5 | 0.043% | 0.258% |
| $5.03 \times 10^{-7}$ | 1.5 | 0.030% | 0.174% |
| $7.85 \times 10^{-7}$ | 1.5 | 0.021% | 0.119% |

In an embodiment of the invention as shown in FIG. 7, the hole density HD range is the Full Width at 80% Maximum (FW80%M), i.e. in the range of from X to Y, X is from 0.029% to 0.113%, and Y is from to 0.071% to 0.295%. In an embodiment, X and Y satisfy the following equations:

$$X=(-1.11\times10^{-4})+(6.23\times10^{-6})(Ao)^{-1/3}+(-2.27\times10^{-4})(Ma/Mo)^{2/3};\text{ and}$$

$$Y=(-4.44\times10^{-4})+(1.70\times10^{-5})(Ao)^{-1/3}+(-5.74\times10^{-4})(Ma/Mo)^{2/3}.$$

The following table lists some exemplary values of Ao ($m^2$), Ma/Mo, and the Full Width at 80% Maximum:

| | | Full Width at 80% Maximum | |
|---|---|---|---|
| Ao ($m^2$) | Ma/Mo | X | Y |
| $1.26\times10^{-7}$ | 0 | 0.113% | 0.295% |
| $1.96\times10^{-7}$ | 0 | 0.096% | 0.248% |
| $2.83\times10^{-7}$ | 0 | 0.084% | 0.214% |
| $3.85\times10^{-7}$ | 0 | 0.075% | 0.189% |
| $5.03\times10^{-7}$ | 0 | 0.067% | 0.169% |
| $6.36\times10^{-7}$ | 0 | 0.061% | 0.153% |
| $7.85\times10^{-7}$ | 0 | 0.056% | 0.140% |
| $1.26\times10^{-7}$ | 0.5 | 0.097% | 0.252% |
| $2.83\times10^{-7}$ | 0.5 | 0.067% | 0.172% |
| $5.03\times10^{-7}$ | 0.5 | 0.051% | 0.127% |
| $7.85\times10^{-7}$ | 0.5 | 0.040% | 0.097% |
| $1.26\times10^{-7}$ | 1 | 0.090% | 0.237% |
| $2.83\times10^{-7}$ | 1 | 0.061% | 0.157% |
| $5.03\times10^{-7}$ | 1 | 0.044% | 0.112% |
| $7.85\times10^{-7}$ | 1 | 0.034% | 0.082% |
| $1.26\times10^{-7}$ | 1.5 | 0.086% | 0.226% |
| $2.83\times10^{-7}$ | 1.5 | 0.057% | 0.145% |
| $5.03\times10^{-7}$ | 1.5 | 0.040% | 0.100% |
| $7.85\times10^{-7}$ | 1.5 | 0.029% | 0.071% |

In the following, various embodiments of a lateral mode microphone as shown in FIG. 4 will be described and illustrated in more details. The term "working" and "functional" can be used interchangeably, unless otherwise specified.

Figure 8A:
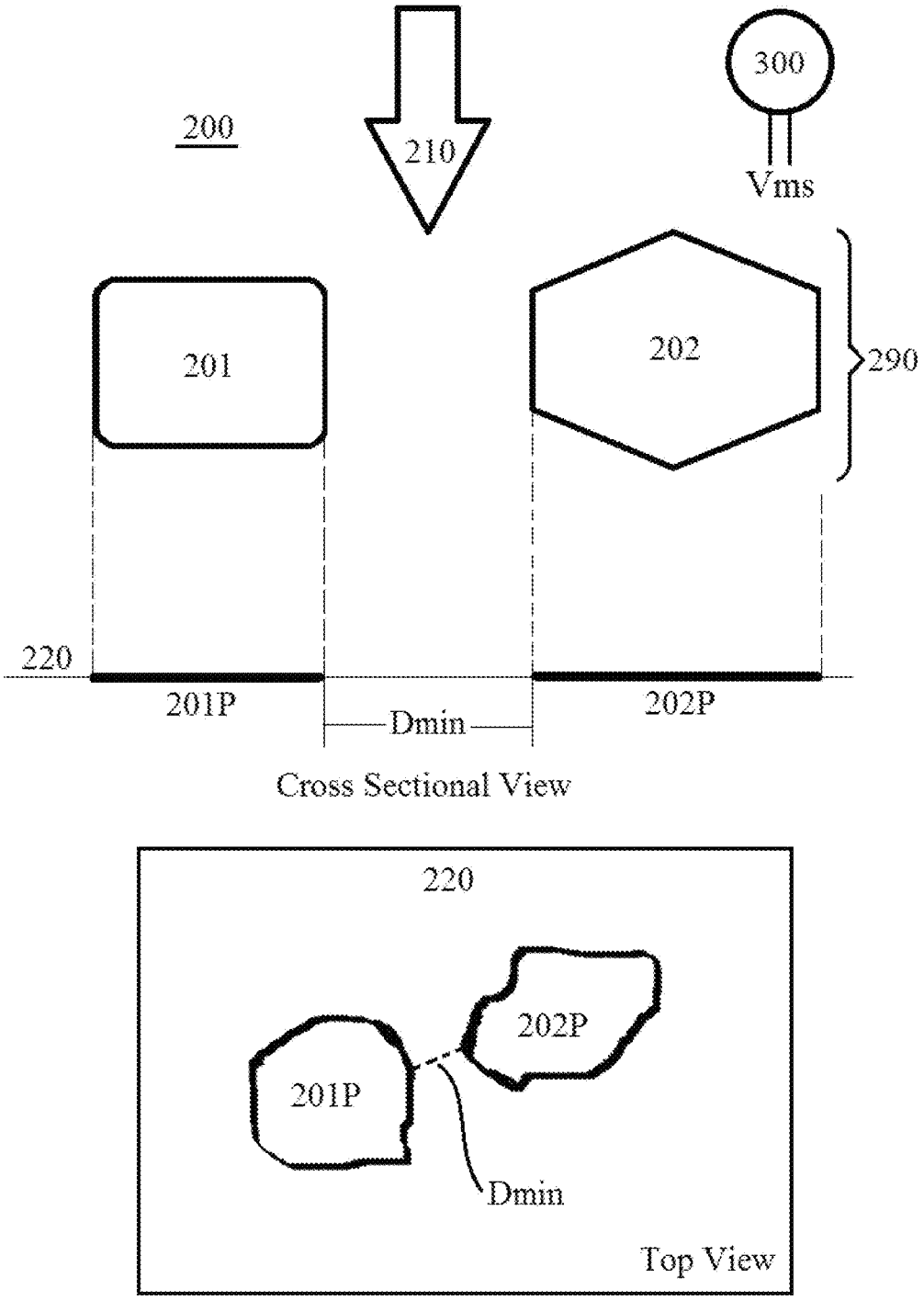
FIG. 8A schematically shows a lateral mode capacitive microphone in accordance with an exemplary embodiment of the present invention.

FIG. 8A illustrates a capacitive microphone 200 such as a MEMS microphone according to various embodiments of the invention. Microphone 200 includes a functional device 290, and a motional sensor 300. In functional device 290, a first electrical working conductor 201 and a second electrical working conductor 202 are configured to have a relative spatial relationship therebetween so that a mutual capacitance can exist between them. Conductors 201 and 202 are independently of each other made of polysilicon, gold, silver, nickel, aluminum, copper, chromium, titanium, tungsten, and platinum. The relative spatial relationship as well as the mutual capacitance can both be varied by an acoustic pressure impacting upon conductors 201 and/or 202.

Figure 9:
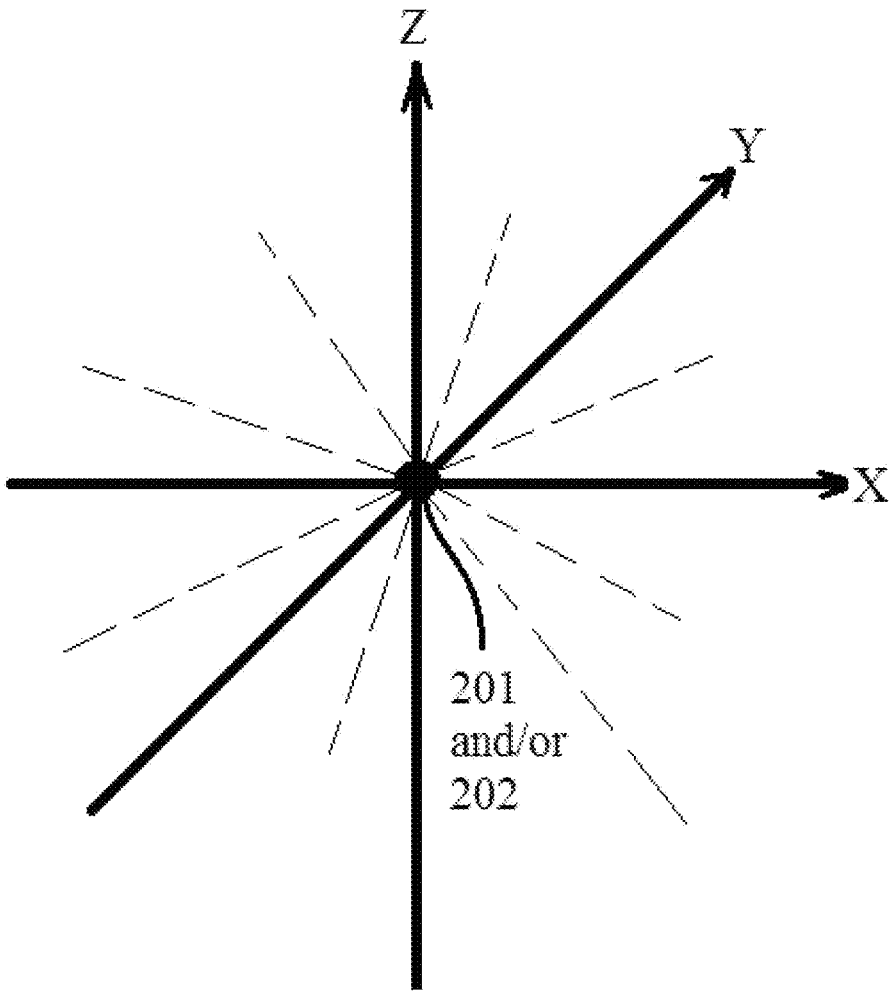
FIG. 9 illustrates acoustic pressures impacting a microphone along a range of directions.

As shown in FIG. 9, an acoustic pressure as represented by dotted lines may impact 201 and/or 202 along a range of impacting directions in 3D space. While the acoustic pressure can cause a variation Va of the mutual capacitance, an acceleration of the capacitive microphone 200 can also cause a variation Vm of the mutual capacitance as a noise. The total ("gross") signal as measured by functional device 290 is defined as Vtotal=Va+Vm. Within microphone 200, a motional sensor 300 is designed to estimate Vm only, and to output a capacitance Vms, which is used to compensate Vtotal in real-time, or cancel off Vm component in Vtotal as accurately as possible.

Figure 10:
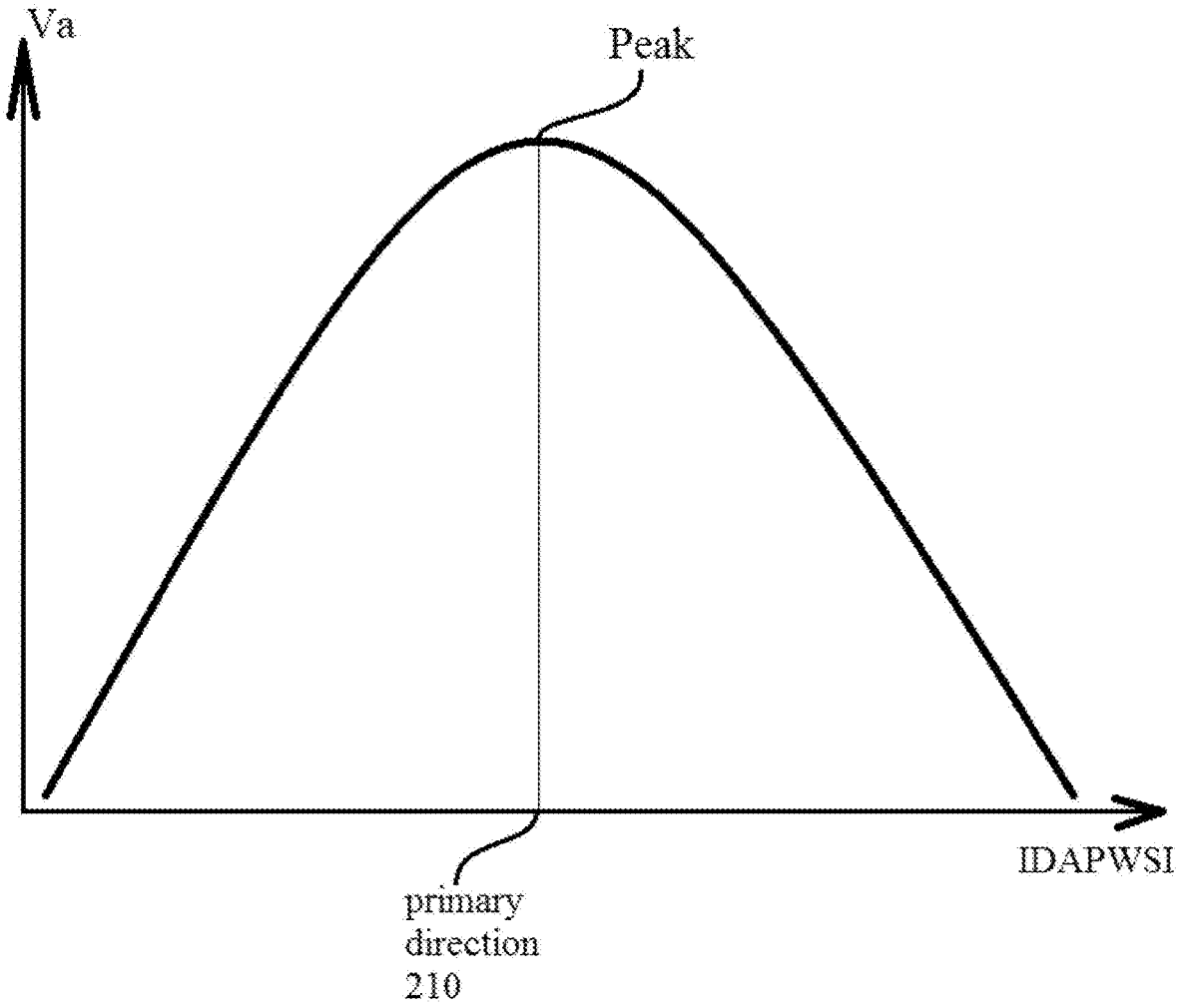
FIG. 10 illustrates the methodology on how to determine the primary working direction for the internal components in a microphone in accordance with an exemplary embodiment of the present invention.

Given the same strength/intensity of acoustic pressure, the mutual capacitance can be varied the most (or maximally varied) by an acoustic pressure impacting upon conductor 201 and/or conductor 202 along a certain direction among the above range of impacting directions as shown in FIG. 9. The variation of mutual capacitance Va caused by various impacting directions of acoustic pressure from 3D space with same intensity (IDAPWSI) is conceptually plotted in FIG. 10. A primary working direction is defined as the impacting direction that generates the peak value of Va, and is labeled as direction 210 in FIG. 8A. It should be appreciated that, given the same strength/intensity of acoustic pressure, the relative spatial relationship can also be varied the most (or maximally varied) by an acoustic pressure impacting upon conductor 201 and/or conductor 202 along a certain direction X among the range of impacting directions as shown in FIG. 9. Direction X may be the same as, or different from, the primary working direction 210 as defined above. In some embodiments of the invention, the primary working direction may be alternatively defined as the direction X.

Referring back to FIG. 8A, conductor 201 has a first working projection 201P along direction 210 on a conceptual working plane 220 that is perpendicular to direction 210. Similarly, conductor 202 has a second working projection 202P along direction 210 on plan 220. Projection 201P and projection 202P have a shortest working distance Dmin therebetween. In the present invention, Dmin may be constant or variable, but it is always greater than zero, no matter conductor 201 and/or conductor 202 are/is being impacted by an acoustic pressure along direction 210 or not.

Figure 8B:
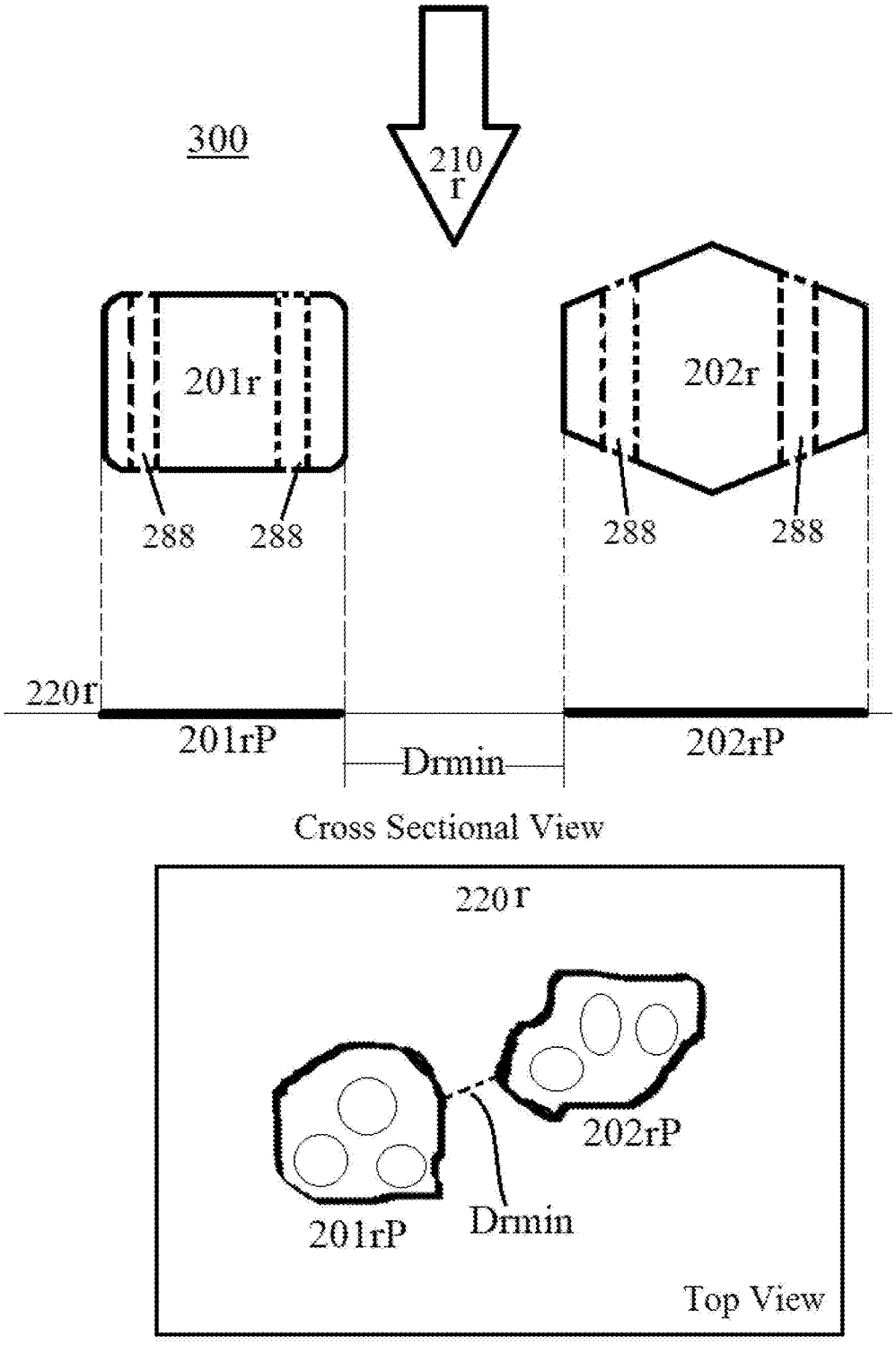
FIG. 8B illustrates a motional sensor in the lateral mode capacitive microphone in accordance with an exemplary embodiment of the present invention.

FIG. 8B schematically illustrates an exemplary motional sensor 300 in the lateral mode capacitive microphone 200. Motional sensor 300 is almost identical to functional device 290 as shown in FIG. 8A. By "almost identical", it means that the only difference between device 290 and sensor 300 is that the resistance $R_{fd}$ of conductor 201 and/or conductor 202 against an impacting acoustic pressure is much greater than the resistance $R_{ms}$ of the counterparts of conductor 201 and/or conductor 202 in motional sensor 300 (i.e. conductors 201*r* and 202*r*) against the same impacting acoustic pressure. Therefore, reference numbers in FIG. 8B with a suffix "r" such as 201*r*, 202*r*, 210*r*, 220*r*, 201*r*P, 202*r*P, and Dr min have identical meanings (mutatis mutandis) as those in FIG. 8A such as 201, 202, 210, 220, 201P, 202P, and Dmin, and will not be explained here again for conciseness. A term "reference" instead of "working" is used in the nomenclature for motional sensor 300 to distinguish it from functional device 290. For example, the counterpart of the first electrical working conductor 201 in functional device 290 is named as "the first electrical reference conductor 201*r*" in motional sensor 300.

An acoustic pressure can impact, but impact much less than that against functional device 290 as shown in FIG. 2A, upon one or both of conductors 201*r* and 202*r*, along a range of impacting reference directions in 3D space, but it can still cause a variation Va' of the mutual capacitance. An acceleration or vibration of the capacitive microphone 200 can also cause a variation Vm' of the mutual capacitance, and Vms=Va'+Vm'. A corrected output Vct=Vtotal−Vms is used as the output of the microphone 200. In preferred embodiments, motional sensor 300 is identical to functional device 290 as shown in FIG. 8A with only one difference, i.e., conductors 201*r* and/or 202*r* have much less air resistance, or very little response to the impacting acoustic pressure. As a result, Va' has a minimal value and is near zero, Vm' is close to Vm, and therefore Vms is close to V'm. In an embodiment, conductors 201*r* and/or 202*r* have air ventilation device(s) 288 for air to go through them with reduced impacting force. In various embodiments, Va'<20% Va, and 80% Vm<Vm'<Vm. For example, Va'=3.5% Va, and Vm'=96.9% Vm.

Figure 8C:
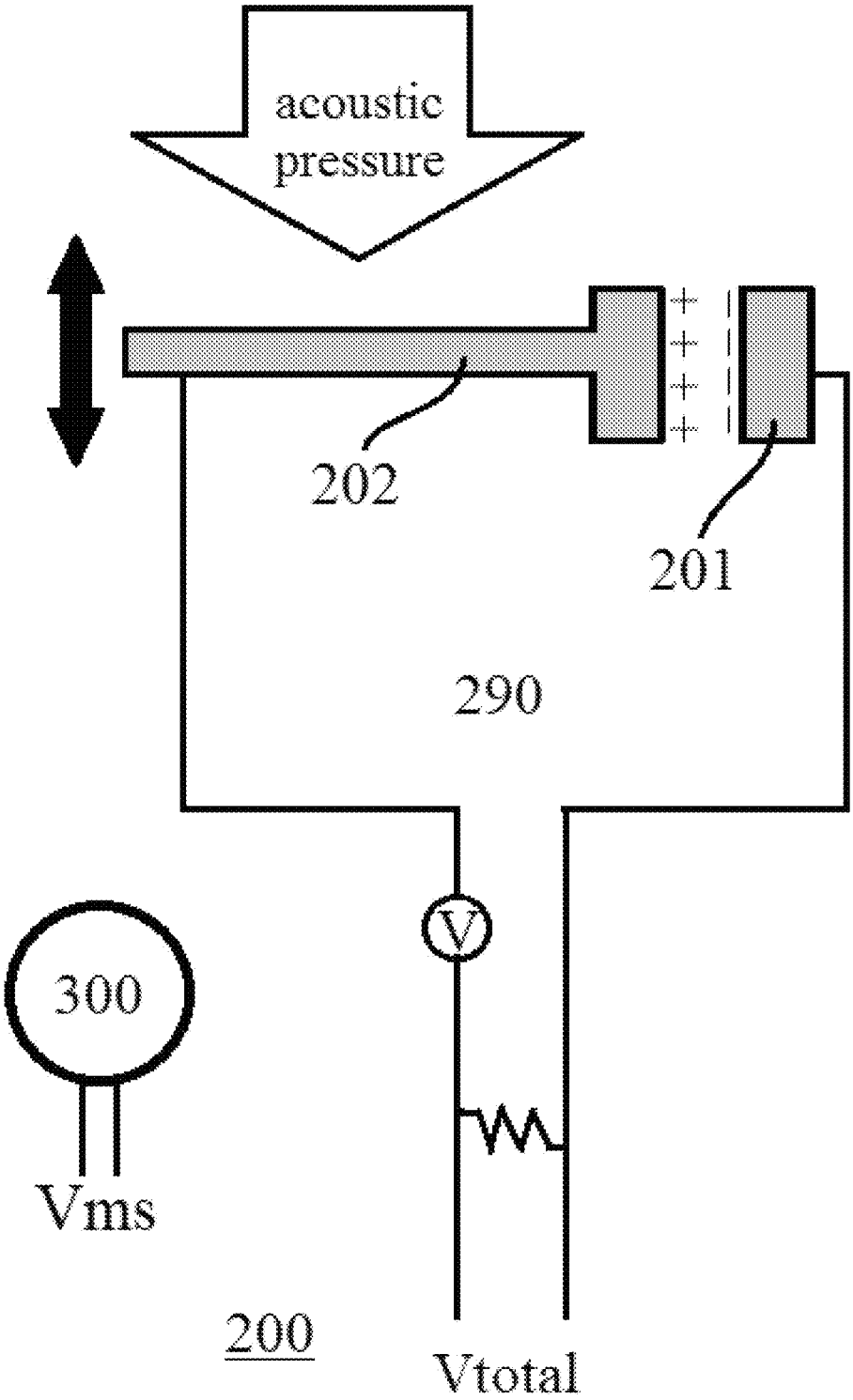
FIG. 8C illustrates a lateral mode capacitive microphone in accordance with an exemplary embodiment of the present invention.

FIG. 8C illustrates a more specific but still exemplary embodiment of the microphone in FIG. 8A. Microphone 200 includes a functional device 290 and a motional sensor 300. Working conductor 201 is stationary, and has a function similar to the fixed backplate in the prior art. A large flat area of working conductor 202, or working membrane 202, similar to movable/deflectable membrane/diaphragm 102 in FIG. 1A, receives acoustic pressure and moves up and down along the primary working direction, which is perpendicular to the large flat area. However, conductors 201 and 202 are configured in a side-by-side spatial relationship, unlike the stack configuration shown in FIG. 1A. As one "plate" of the capacitor, i.e. conductor 202, does not move mainly toward and from conductor 201. Instead, conductor 202 mainly moves laterally over, or "glides" over, conductor 201, producing changes in the overlapped area between 201 and 202, and therefore varying the mutual capacitance therebetween. As described in U.S. application Ser. No. 15/393,831, capacitive microphone 200 based on such a relative movement between conductors 201 and 202 is called lateral mode capacitive microphone, or simply lateral microphone.

Figure 8D:
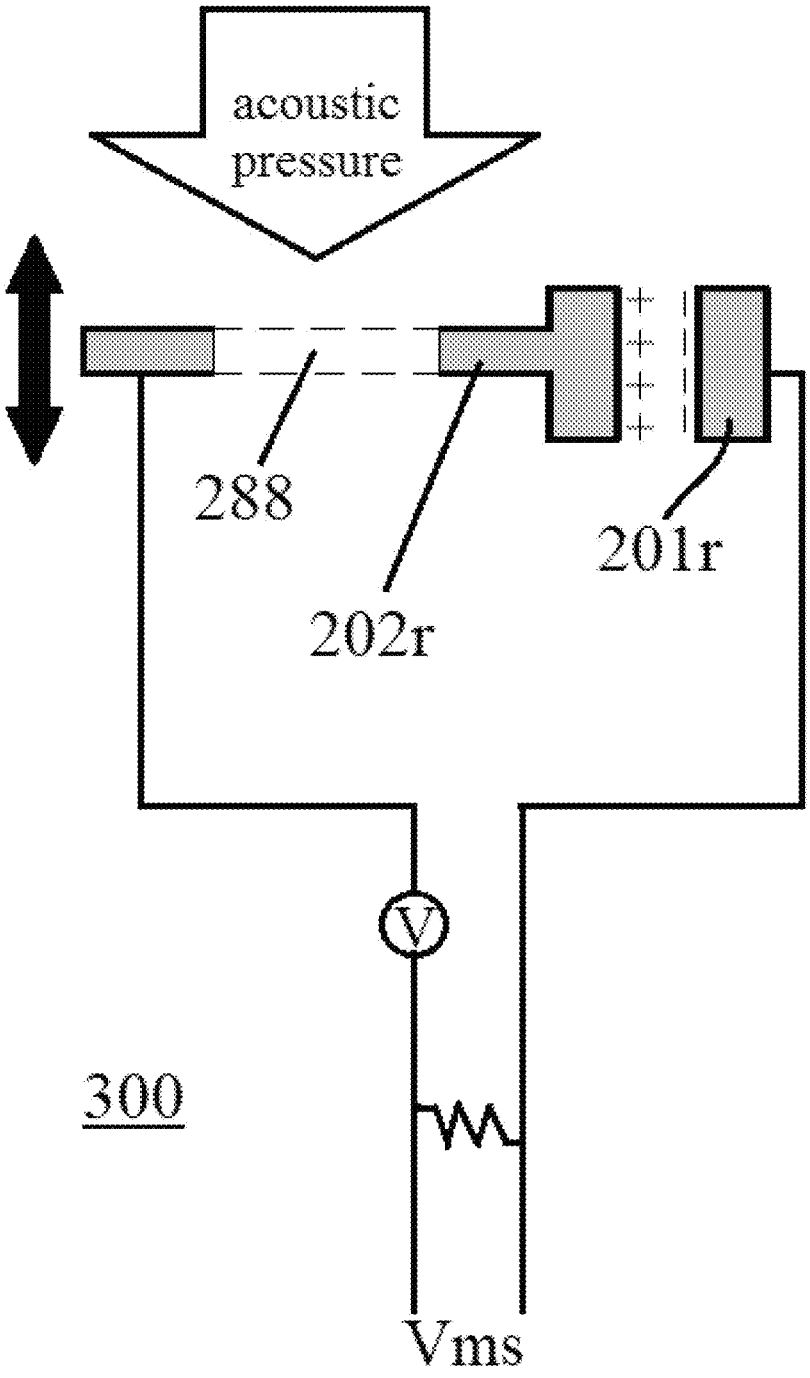
FIG. 8D illustrates a motional sensor in the lateral mode capacitive microphone in accordance with an exemplary embodiment of the present invention.

FIG. 8D schematically illustrates a motional sensor 300 in the lateral microphone 200. Motional sensor 300 may be identical to functional device 290 as shown in FIG. 2C except that movable/deflectable membrane/diaphragm 202*r*, or reference conductor/membrane 202*r*, has less air resistance than the working membrane 202. For example, reference membrane 202*r* may have one or more openings 288 thereon for air ventilation and reducing air resistance, while working membrane 202 has no such opening(s) or has less opening(s). As a result, reference membrane 202*r* receives little acoustic pressure, and moves up and down mainly in response to the acceleration or vibration of the microphone 200.

Figure 11A:
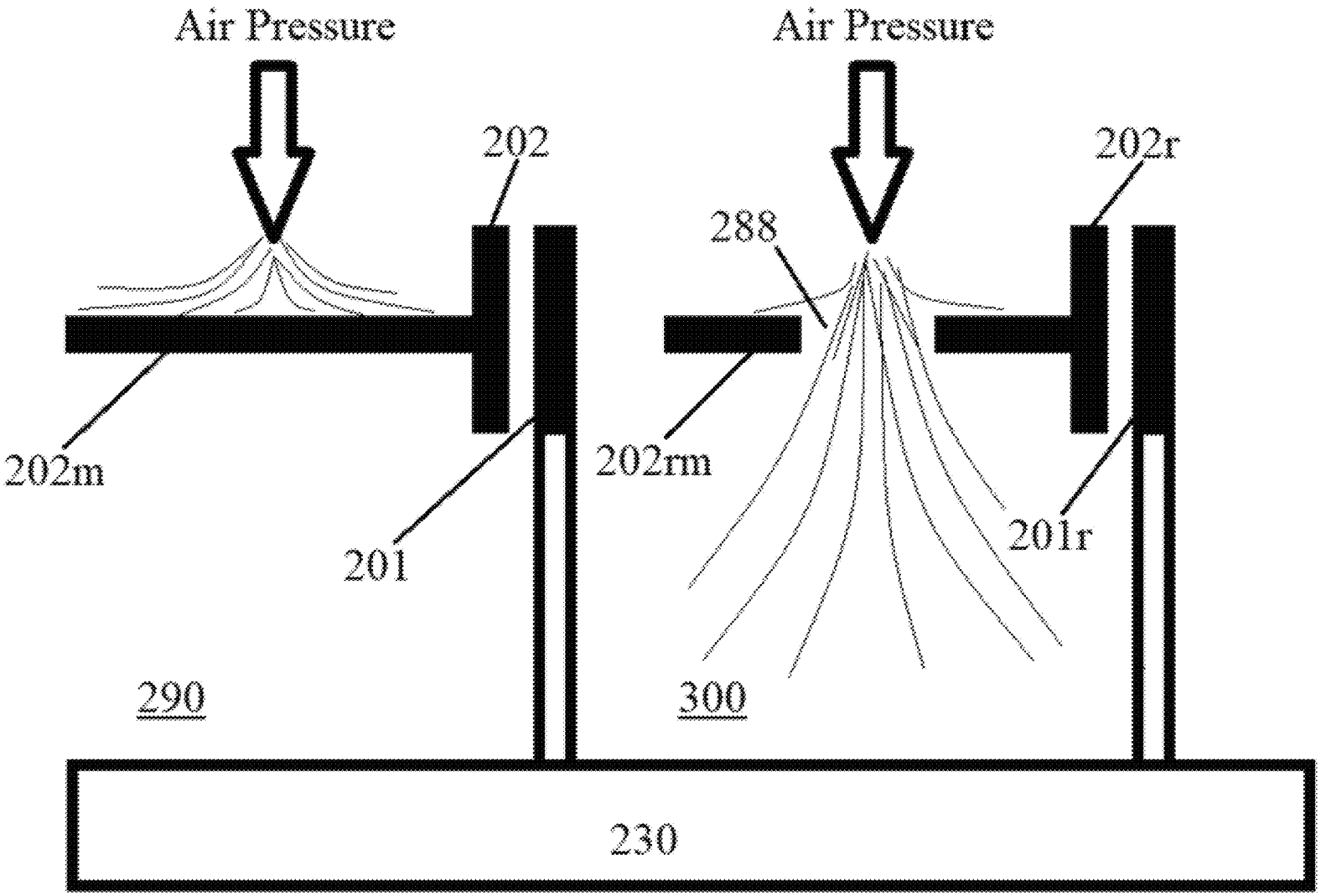
FIG. 11A schematically shows a MEMS capacitive microphone in accordance with an exemplary embodiment of the present invention.

FIG. 11A illustrates a more specific embodiment of a lateral microphone 200, in which identical conductors 201 and 201*r* are fixed relative to a substrate 230. Conductor 202 comprises a working membrane 202*m* that is movable relative to the substrate 230, and the primary working direction is perpendicular to the working membrane 202*m* plane. Reference conductor 202*r* comprises a reference membrane 202*rm* that is also movable relative to the substrate 230, and the primary reference direction is perpendicular to the reference membrane 202*rm* plane. Working membrane 202*m* plane and reference membrane 202*rm* plane are in parallel with each other. Conductors 202 and 202*r* are identical except that the reference membrane 202*rm* has less air resistance than the working membrane 202*m*. For example, reference membrane 202*rm* may have one or more openings 288 thereon for air ventilation, but the working membrane 202*m* has none.

In exemplary embodiments of the invention, the lateral microphone 200 may be a MEMS (Microelectromechanical System) microphone, AKA chip/silicon microphone. Typically, a pressure-sensitive diaphragm is etched directly into a silicon wafer by MEMS processing techniques, and is usually accompanied with integrated preamplifier. For a digital MEMS microphone, it may include built in analog-to-digital converter (ADC) circuits on the same CMOS chip making the chip a digital microphone and so more readily integrated with digital products.

Figure 11B:
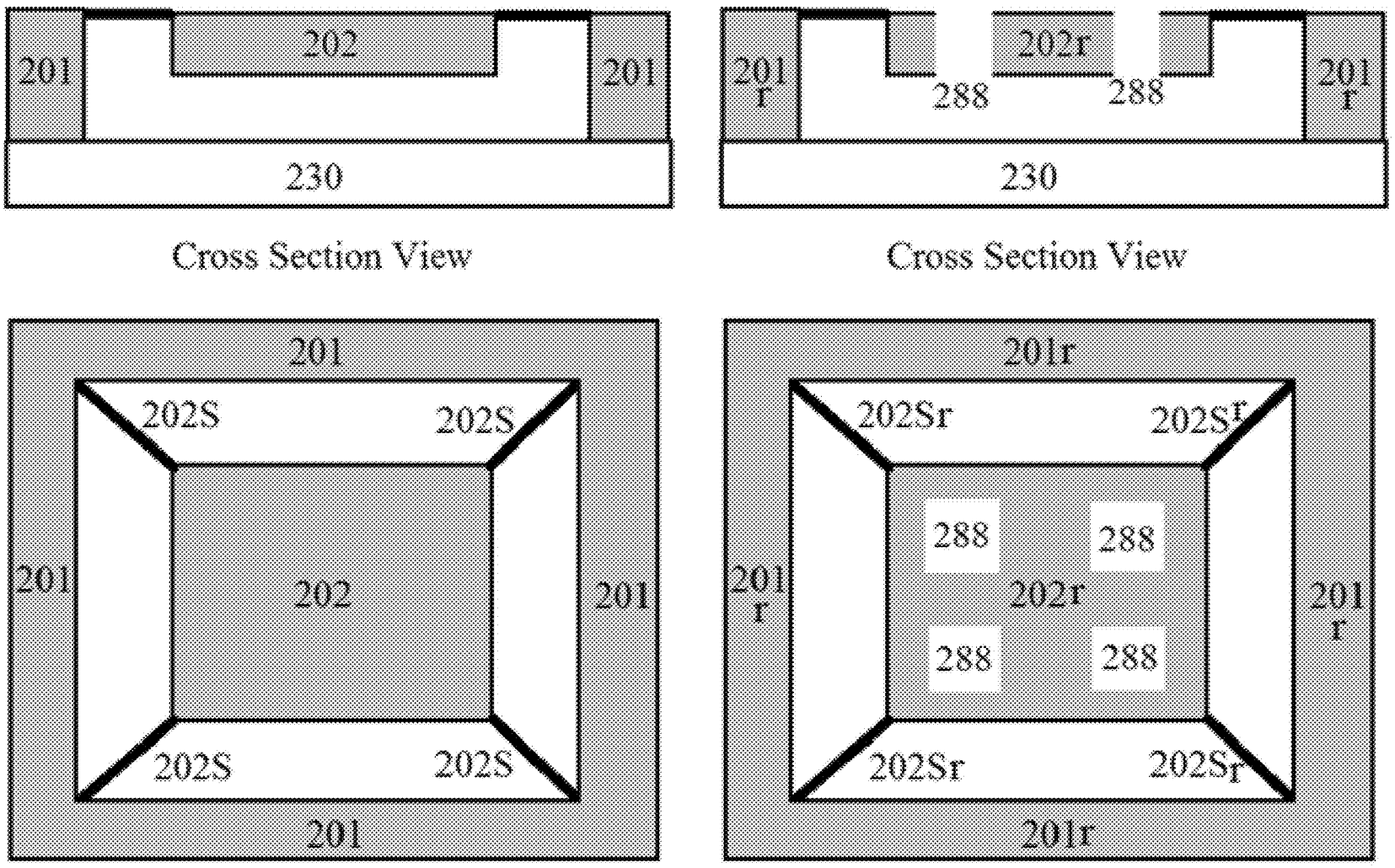
FIG. 11B schematically shows a MEMS capacitive microphone in accordance with an exemplary embodiment of the present invention.

In an embodiment as shown in FIG. 11B, capacitive microphone 200 may include a substrate 230 such as silicon, on which both functional device 290 and motional sensor 300 are fabricated. The substrate 230 can be viewed as the conceptual plane 220/220*r*. Conductor 201/201*r* and conductor 202/202*r* may be constructed above the substrate 230 side-by-side. Alternatively, conductor 201/201*r* may be surrounding conductor 202/202*r*, as shown in FIG. 11B. In an exemplary embodiment, conductor 201/201*r* is fixed to the substrate 230. On the other hand, conductor 202/202*r* may be a membrane that is movable relative to substrate 230. The primary working/reference direction may be perpendicular to the membrane plane of 202/202*r*. Movable membrane 202/202*r* may be attached to the substrate 230 via three or more working suspensions 202S/202Sr such as four working suspensions 202S/202Sr extending from four corners of 202/202*r*. Each of the suspension 202S/202Sr may comprise folded and symmetrical cantilevers (not shown). However, reference membrane 202*r* has air ventilation device(s) such as four square openings or holes 288, and working membrane 202 does not.

Figure 12:
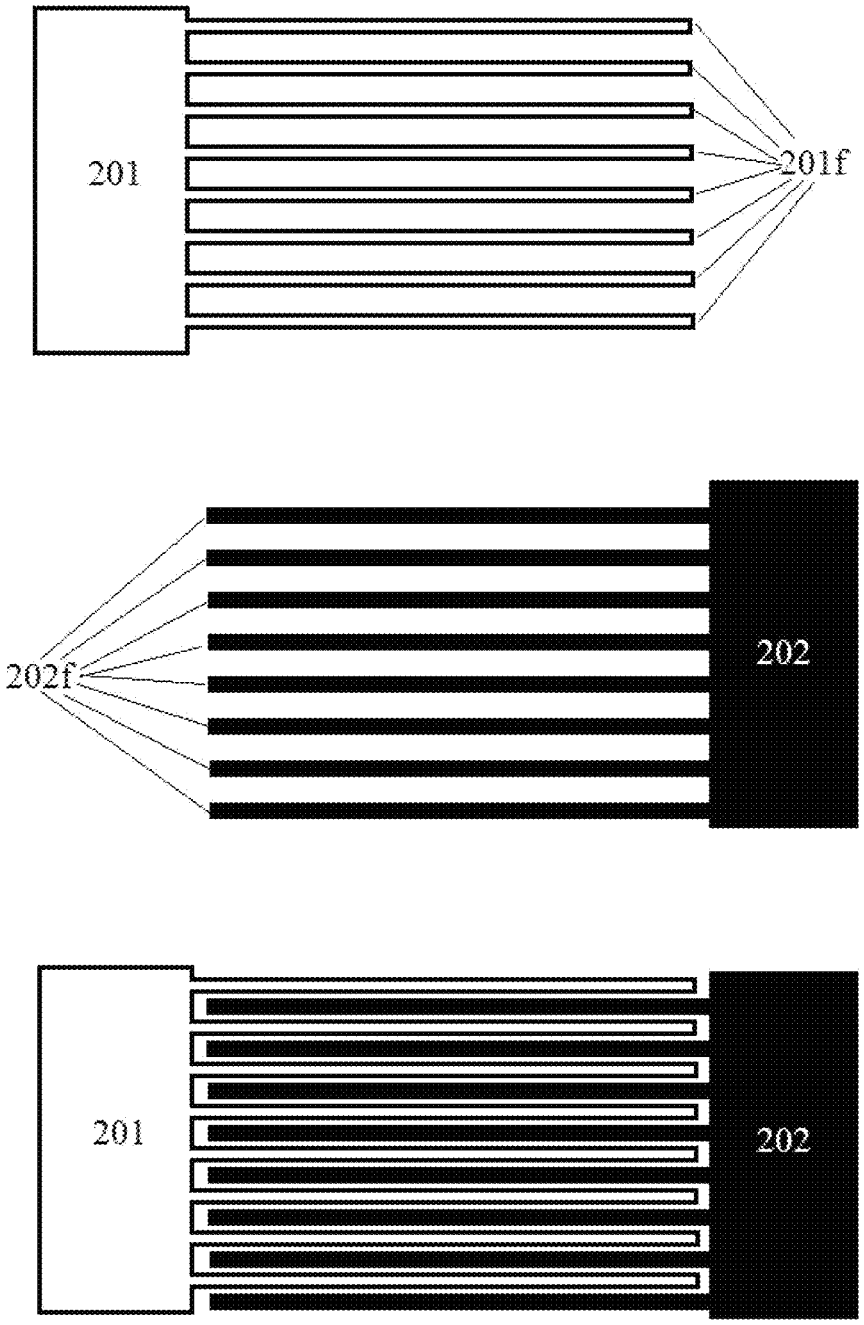
FIG. 12 illustrates the first/second electrical conductors having a comb finger configuration in accordance with an exemplary embodiment of the present invention.

In functional device 290 as shown in FIG. 12, working conductor 201 comprises a first set of working comb fingers 201*f* that is fixed to substrate 230. The movable membrane, i.e. second conductor 202, comprises a second set of working comb fingers 202*f* around the peripheral region of the membrane 202. The two sets of comb fingers 201*f* and 202*f* are interleaved into each other. The second set of comb fingers 202*f* is movable along the primary direction, which is perpendicular to the membrane plane 202, relative to the first set of comb fingers 201*f*. As such, the resistance from air located within the gap between the membrane 202 and the substrate is lowered, for example, 25 times lower squeeze film damping. In a preferred embodiment, comb fingers 201*f* and comb fingers 202*f* have identical shape and dimension. Motional device 300 is identical to functional device 290 regarding comb fingers 201*fl*/201*fr* (not shown) and comb fingers 202*fl*/202*fr* (not shown), and the description thereof is omitted.

Figure 13:
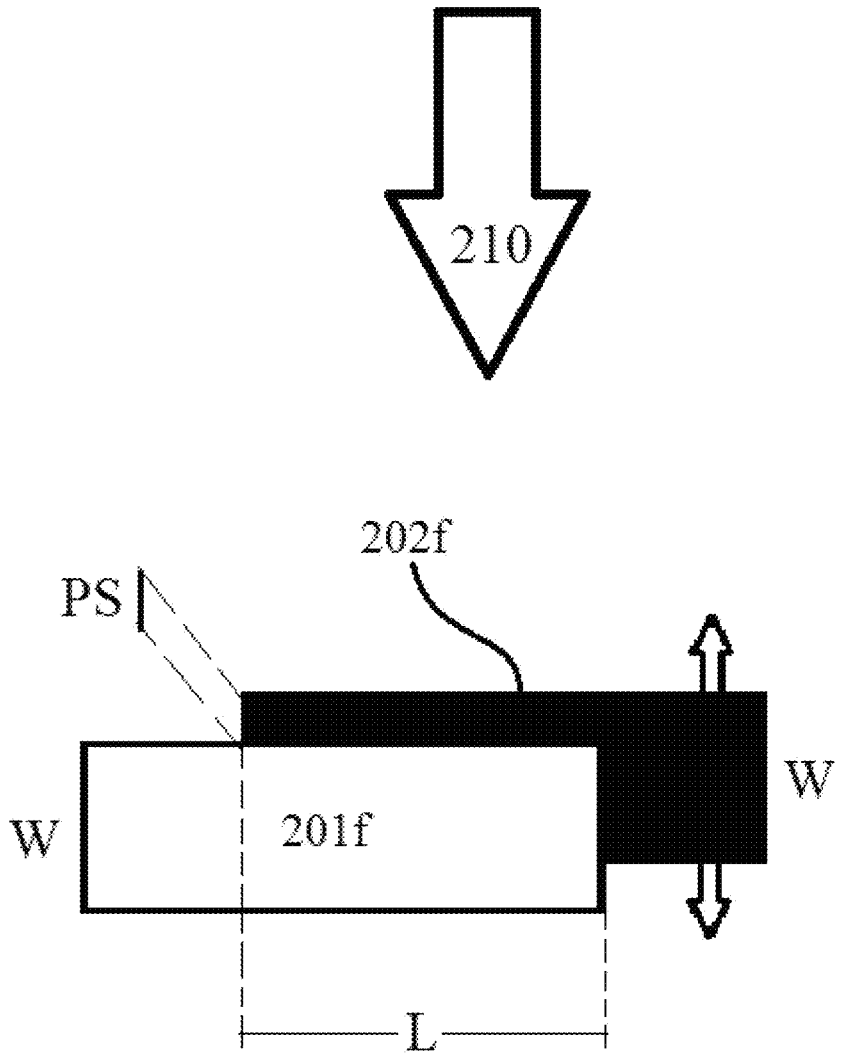
FIG. 13 depicts the spatial relationship between two comb fingers of FIG. 12 in accordance with an exemplary embodiment of the present invention.

As shown in FIG. 13, each comb finger in functional device 290 has a same width W measured along the primary working direction 210, and comb fingers 201*f* and comb fingers 202*f* have a positional shift PS along the primary working direction 210, in the absence of vibration caused by sound wave. For example, the positional shift PS along direction 210 may be one third of the width W, PS=⅓ W. In other words, comb fingers 201*f* and comb fingers 202*f* have an overlap of ⅔ W along direction 210, in the absence of vibration caused by sound wave. Motional device 300 is identical to functional device 290 regarding width Wr, positional shift PSr, and the relationship between them, and the description thereof is omitted.

Referring to FIGS. 12 and 13, working comb fingers 201*f* are fixed on an anchor, and working comb fingers 202*f* are integrated with membrane-shaped working conductor 202 (or working membrane 202). When membrane 202 vibrates due to sound wave, fingers 202*f* move together with membrane 202. The overlap area between two neighboring fingers 201*f* and 202*f* changes along with this movement, so does the capacitance between them. Eventually, a capacitance change signal is detected. In contrast, reference membrane 202 (not shown) is designed to vibrate mainly in response to acceleration, shaking, or vibration of the microphone 200, and not mainly in response to an impacting sound wave.

Figure 14A:
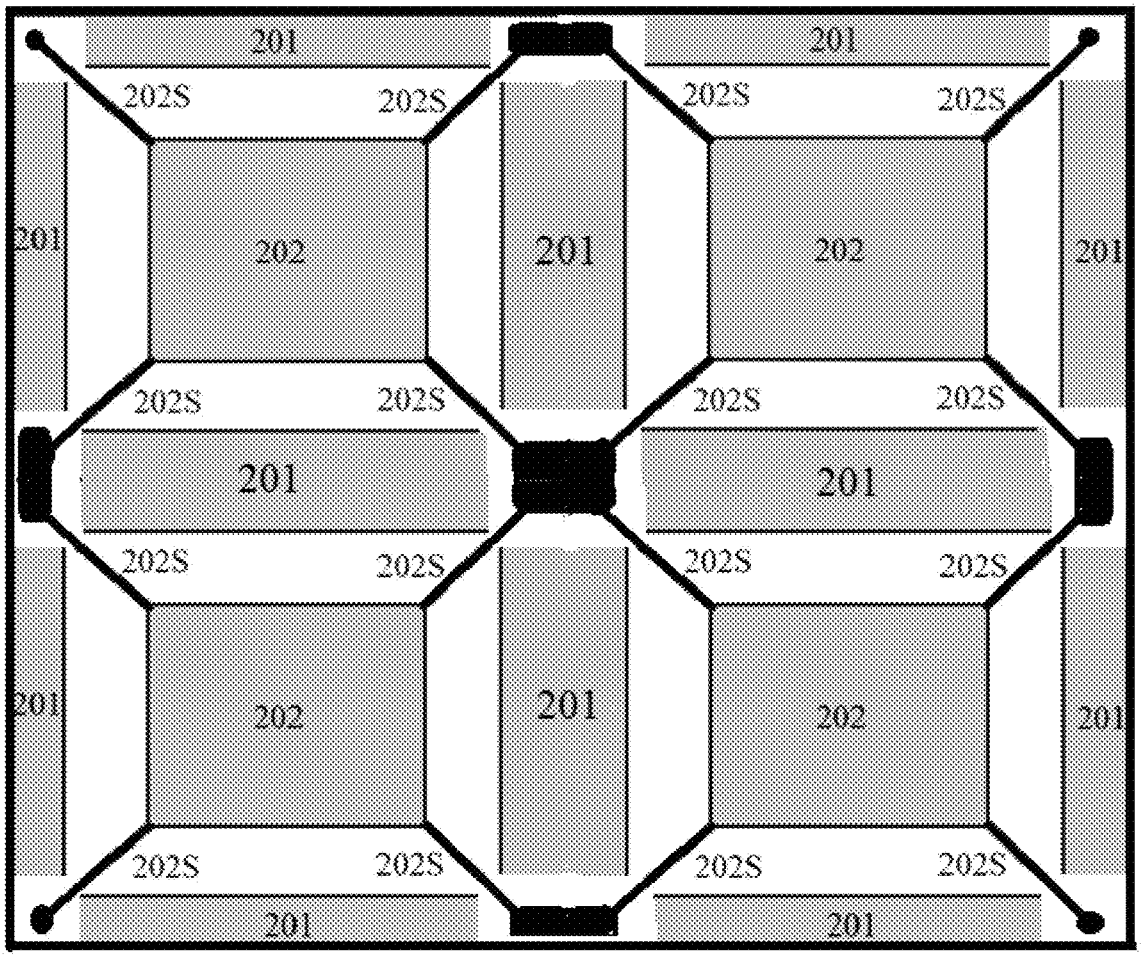
FIG. 14A illustrates a functional device including four identical movable working membranes arranged in a 2×2 array configuration in a co-pending U.S. application filed by the same Applicants.
Figure 14B:
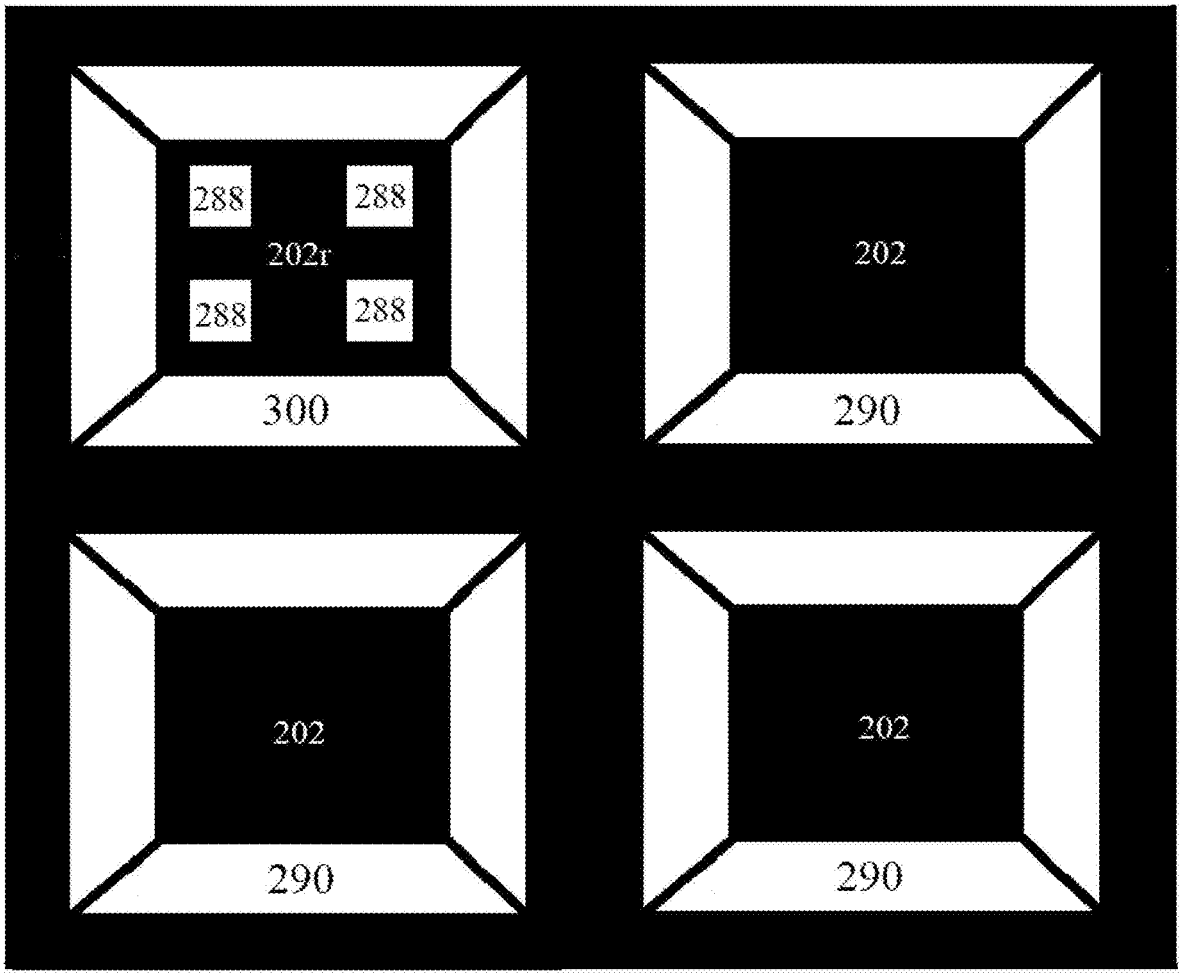
FIG. 14B shows a functional device including one reference membrane and three movable working membranes arranged in a 2×2 array configuration in accordance with an exemplary embodiment of the present invention.
Figure 14C:
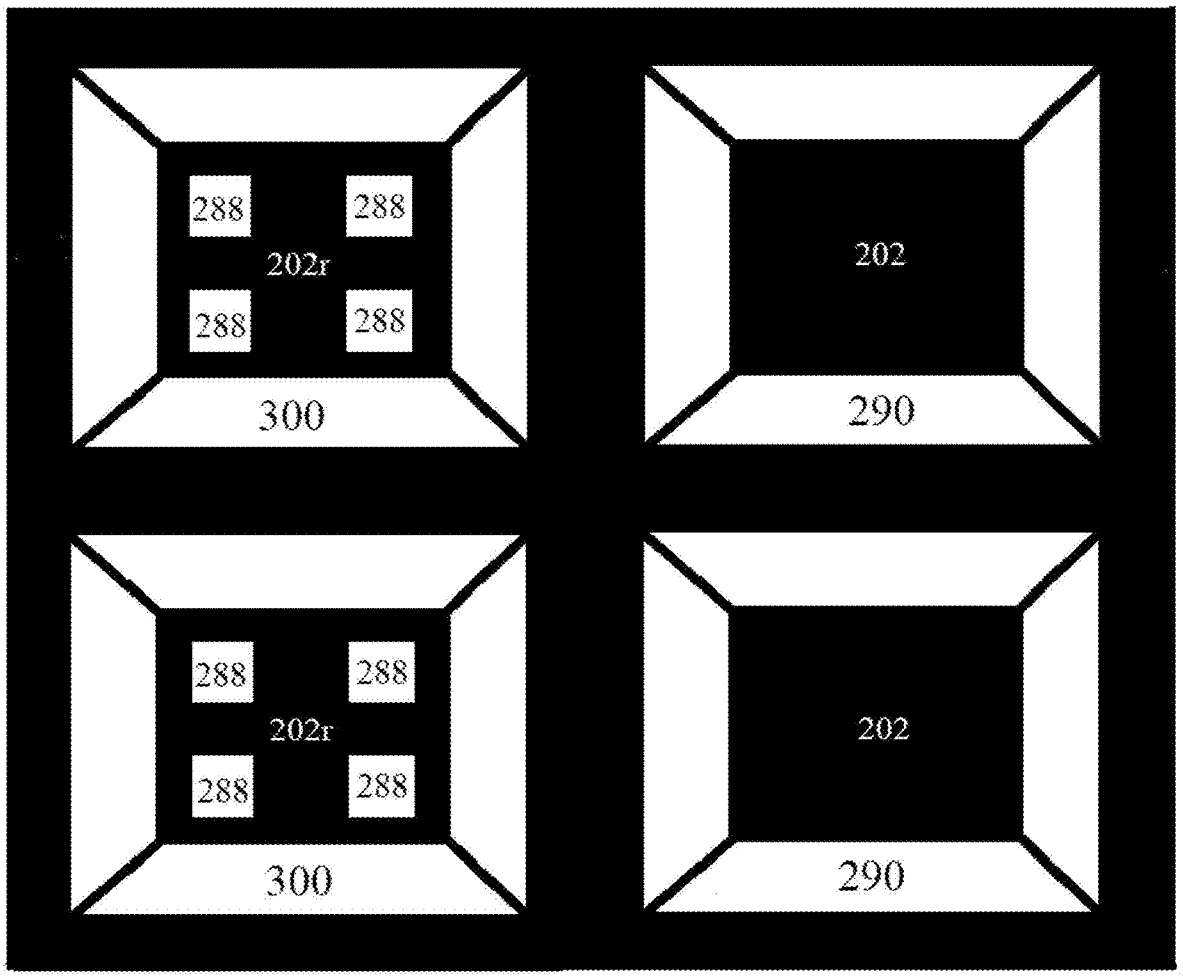
FIG. 14C shows a functional device including two reference membranes and two movable working membranes arranged in a 2×2 array configuration in accordance with an exemplary embodiment of the present invention.
Figure 14D:
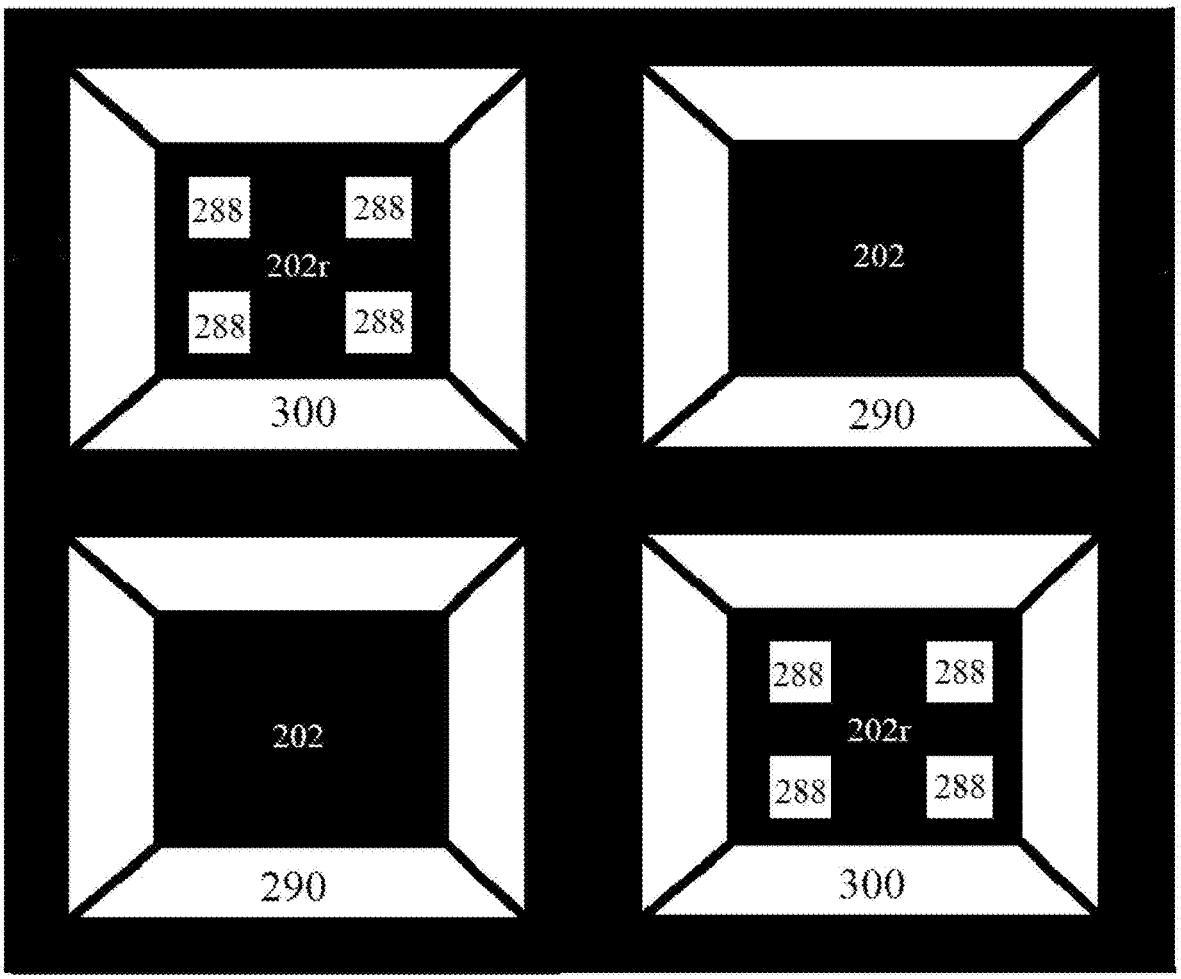
FIG. 14D shows another functional device including two reference membranes and two movable working membranes arranged in a 2×2 array configuration in accordance with an exemplary embodiment of the present invention.

As described in U.S. application Ser. No. 15/393,831, the movable working membrane 202 may have a shape of square. As shown in FIG. 14A, functional device 290 may include one or more movable working membranes 202. For example, four identical membranes 202 can be arranged in a 2×2 array configuration. According to the present invention, one or two of the four working membranes 202 can be converted into reference membrane(s) 202*r* by fabricating or etching one or more opening(s) 288 thereon, e.g. four square leakage holes 288, for air ventilation. FIG. 14B shows a 2×2 array configuration that includes one reference membrane 202*r* and three working membranes 202. FIG. 14C and FIG.

14D show two 2×2 array configurations that each includes two reference membranes 202*r* and two working membranes 202.

Figure 15:
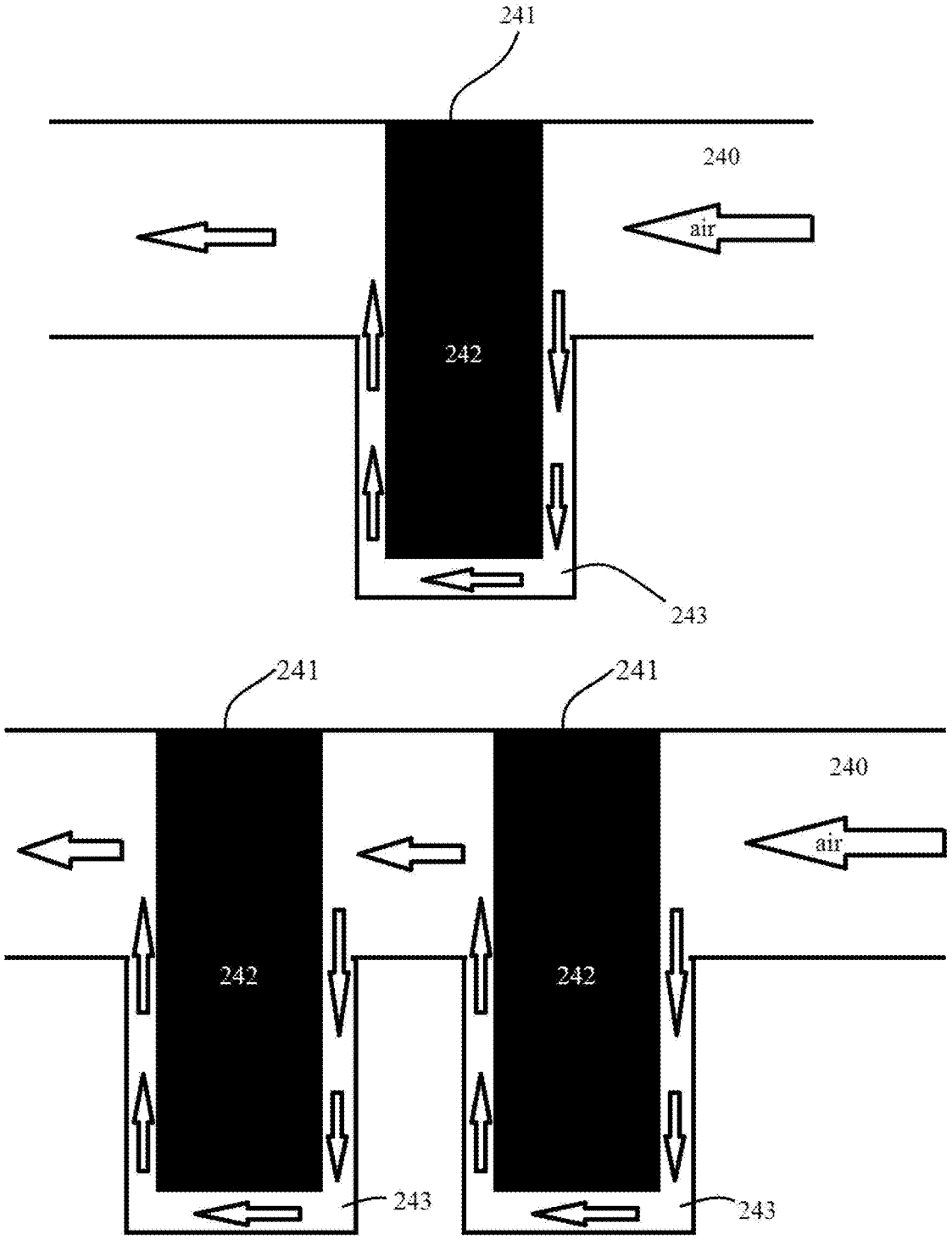
FIG. 15 demonstrates the design of one or more such as two air flow restrictors in accordance with an exemplary embodiment of the present invention.

In some embodiments as shown in FIG. 15, functional device 290 of the invention comprises one or more such as two air flow working restrictors 241 that restrict the flow rate of air that flows in/out of the gap between the working membrane 202 and the substrate 230. Restrictors 241 may be designed to decrease the size of a working air channel 240 for the air to flow in/out of the gap. Alternatively or additionally, restrictors 241 may increase the length of the working air channel 240 for the air to flow in/out of the gap. For example, restrictors 241 may comprise an insert 242 into a groove 243, which not only decreases the size of air channel 240, but also increases the length of the air channel 240. Motional device 300 is identical to functional device 290 regarding restrictors 241/241*r*, air channel 240/240*f*, insert 242/242*r* and groove 243/243*r*, and the description thereof is omitted.

Figure 16:
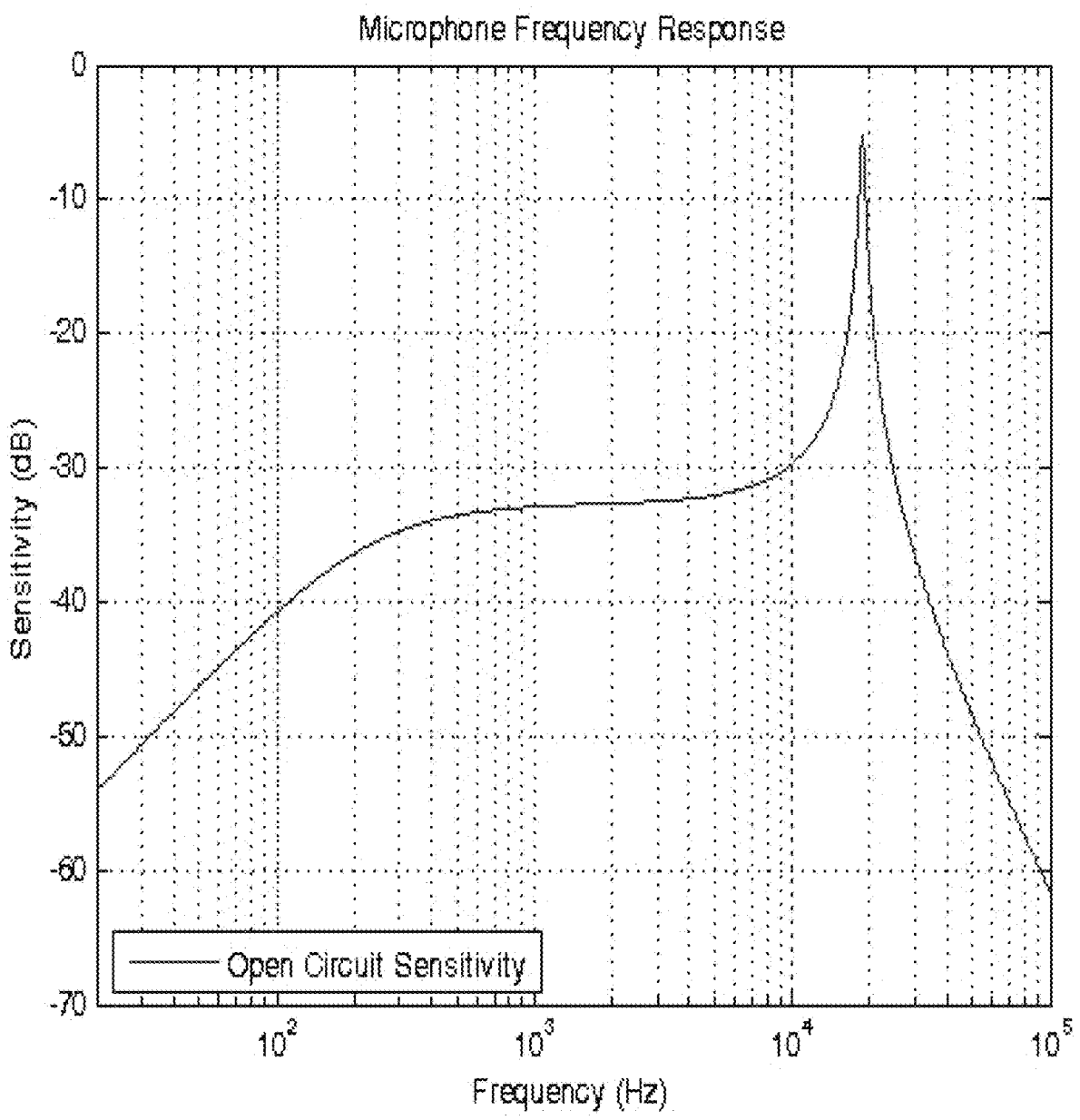
FIG. 16 shows that microphone sensitivity drops at low frequency due to air leakage.

Air flow working restrictors can help solve the leakage problem associated with microphone design. In conventional parallel plate design as shown in FIG. 1A, it typically has a couple of tiny holes around the edge in order to let air go through slowly, to keep air pressure balance on both sides of membrane 101 in low frequency. That is a desired leakage. However, a large leakage is undesired, because it will let some low frequency sound wave escape away from membrane vibration easily via the holes, and will result in a sensitivity drop in low frequency. FIG. 16 shows that sensitivity drops at low frequency due to leakage. For a typical capacitive MEMS microphone, the frequency range is between 100 Hz and 20 kHz, thus the sensitivity drop in FIG. 16 is undesired.

Figure 17:
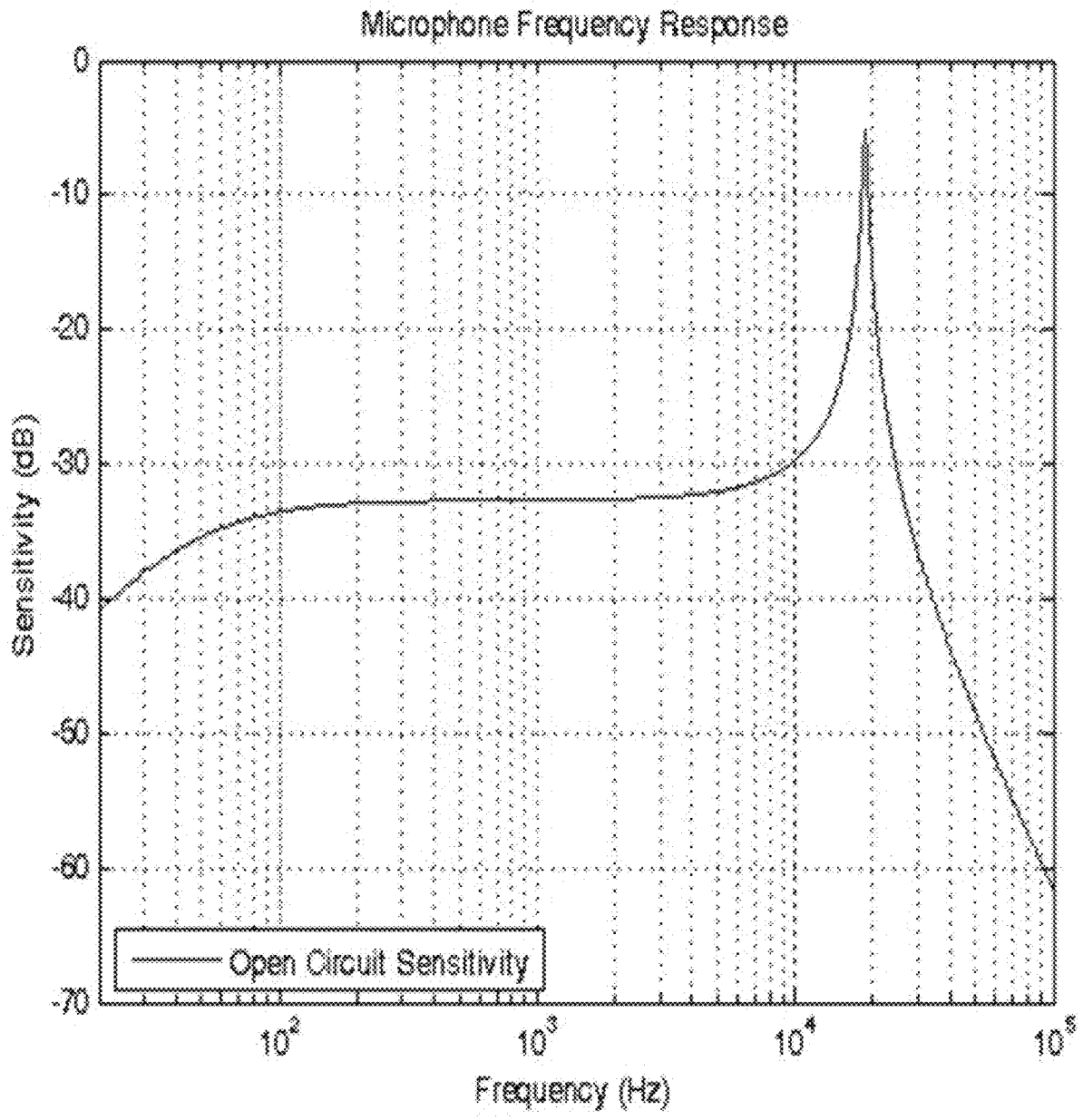
FIG. 17 shows the frequency response with air leakage reduced/prevented in accordance with an exemplary embodiment of the present invention.

In order to prevent this large leakage, a structure is designed and shown in FIG. 15, which illustrates a leakage prevent groove or slot and wall. Referring back to FIG. 15, air flow restrictors 241 may function as a structure for preventing air leakage in the microphone 200 of the invention. Air flow restrictor 241 comprises an insert 242 into a groove 243, which not only decreases the size of an air channel 240, but also increases the length of the air channel 240. In MEMS microphones, a deep slot may be etched on substrate around the edge of square membrane 202 and then a wall 242 connected to membrane 202 is deposited to form a long and narrow air tube 240, which gives a large acoustic resistance. FIG. 17 depicts the frequency response with leakage being prevented. This leakage prevention structure has a significant effect on keeping the frequency response plot more flat on the range 100 Hz to 1000 Hz. The level of the air resistance may be controlled by the slot depth etched on the substrate. The deeper slot, the higher the resistance.

In the following, a preferred embodiment of the invention will be analyzed using some theories and modeling. However, it should be understood that the present invention is not limited or bound by any particular theory and modeling.

Figure 18:
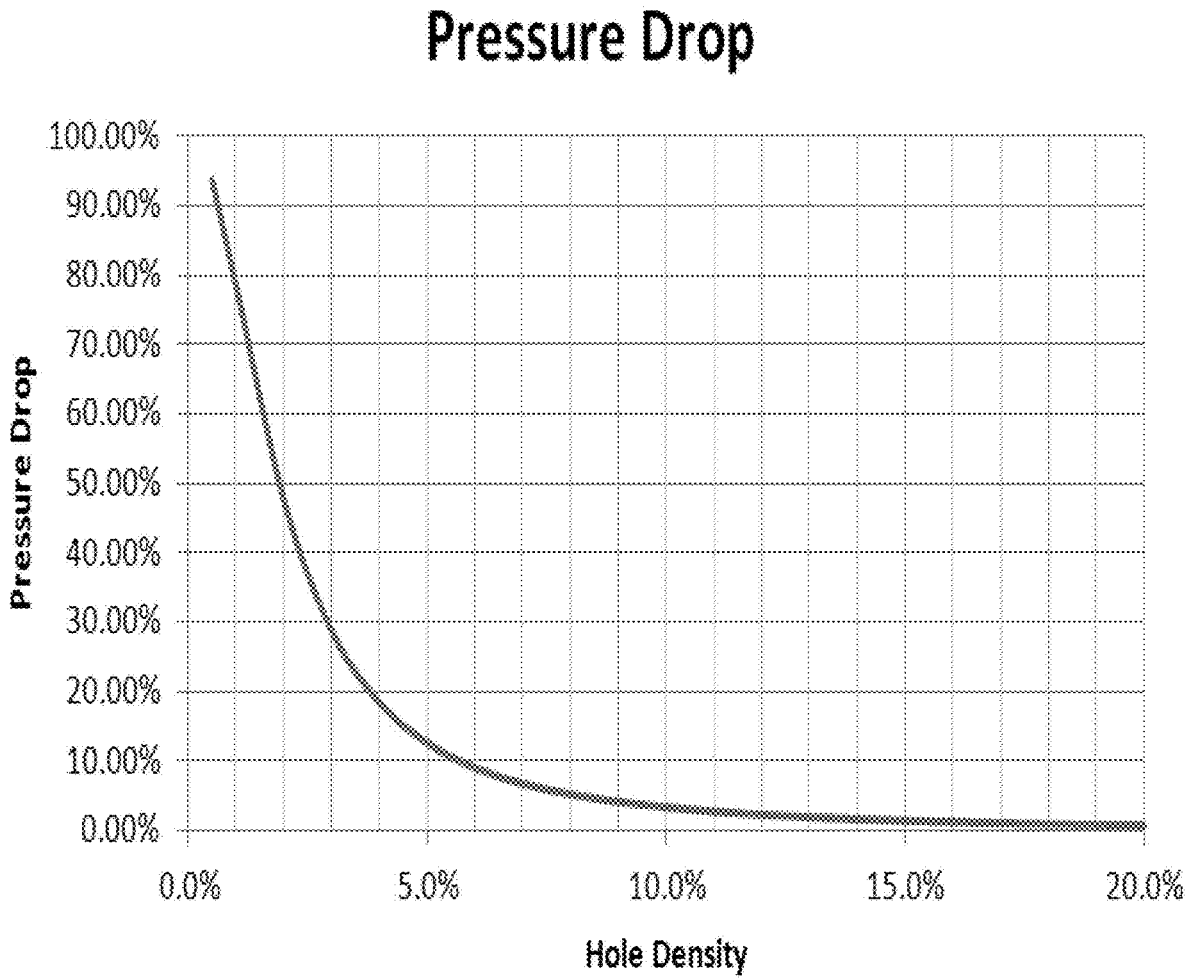
FIG. 18 demonstrates a plot of relationship between Pressure Drop value and hole/opening density on a reference membrane.

On reference membrane 202*r* as shown in FIG. 11B, 14B, 14C or 14D, there are 4 holes 288, which lead to a huge leakage of sound pressure between the two sides of membrane 202*r*. A concept of Pressure Drop may be employed to represent pressure difference between two sides of membrane 202*r*. If there is no hole 288 on membrane 202 (functional or working membrane 202), the Pressure Drop value is above 97% (higher value means more sound pressure converted to membrane movement). The larger density, or area ratio, taken by holes 288 on membrane 202*r*, the less Pressure Drop will be, as FIG. 18 shows. When the Pressure Drop value drops near to 0, sound pressure can directly penetrate reference membrane 202*r* through holes/openings 288, and the membrane 202*r* doesn't respond to sound pressure. Then we can fabricate a pair of identical membranes 202 and 202*r* except for holes 288. While working membrane 202 is functional to detect the sum of sound and acceleration signals Vtotal, reference membrane 202*r* is functional to detect acceleration signal Vms. By canceling the signal coming from acceleration, a corrected output Vct=Vtotal−Vms is obtained.

In the embodiment such as that shown in FIG. 11A, working membrane 202*m* may be an example of basic functional membrane 23 in FIG. 2, and part(s) in conductor 202 other than working membrane 202*m* may be one or more additional parts 24 in FIG. 2. Reference membrane 202*rm* may be an example of basic reference membrane 26 in FIG. 2, and part(s) in conductor 202*r* other than reference membrane 202*rm* may be one or more additional parts 27 in FIG. 2. One or more openings 288 in FIG. 11A may be examples of "one or more holes 28" in FIG. 2. In the embodiment such as that shown in FIGS. 12-13, working comb fingers 202*f* and reference comb fingers 202*fr* may be examples of "one or more additional parts" 24 and 27 in FIG. 2, respectively. In the embodiment such as that shown in FIG. 15, inserts 242 and 242*r* may be examples of "one or more additional parts" 24 and 27 in FIG. 2, respectively. Therefore, all these examples, or any combination thereof, are species of the capacitive microphone 21 as shown in FIGS. 2 and 4-7, in which the total area of said one or more holes 28 is Ah, a hole density HD is defined as Ah/Ao (%), and HD is in the range of from 0.012% to 2.647%.

In the foregoing specification, embodiments of the present invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicant to be the scope of the invention, is the literal and equivalent scope of the set of claims that issue from this application, in the specific form in which such claims issue, including any subsequent correction.

The invention claimed is:

1. A capacitive microphone having a capability of acceleration noise cancelation, comprising:

a moveable functional membrane comprising a basic functional membrane with an area Ao;

a moveable reference membrane comprising a basic reference membrane, wherein the basic reference membrane has one or more holes through the membrane's thickness, and wherein the moveable reference membrane is identical to the moveable functional membrane except that the basic reference membrane has said one or more holes, wherein the total area of said one or more holes is Ah, wherein a hole density HD is defined as Ah/Ao (%), and HD is in the range of from 0.012% to 2.647%, wherein the moveable functional membrane comprises (1) the basic functional membrane with a mass of Mo≥0 and an area of Ao square meters ($m^2$), and (2) one or more additional parts that are attached to, and moveable along with, the basic functional membrane, and wherein the total mass of said one or more additional parts is Ma≥0;

wherein the moveable reference membrane comprises (1) the basic reference membrane, and (2) one or more additional parts that are attached to, and moveable along with, the basic reference membrane, and wherein the total mass of said one or more additional parts is Ma≥0, and wherein the hole density HD is in the range of from X to Y, and X and Y satisfy the following equations:

$$X=(-4.95\times10^{-5})+(2.57\times10^{-6})(Ao)^{-1/3}+(-9.44\times10^{-5})(Ma/Mo)^{2/3};\text{ and}$$

$$Y=(-5.93\times10^{-3})+(1.62\times10^{-4})(Ao)^{-1/3}+(-4.71\times10^{-3})(Ma/Mo)^{2/3}.$$

2. The capacitive microphone according to claim 1, wherein X is from 0.012% to 0.046%, and Y is from to 0.602% to 2.647%.

3. The capacitive microphone according to claim 1, wherein the moveable functional membrane comprises (1) the basic functional membrane with a mass of Mo>0 and area of Ao square meters ($m^2$), and (2) one or more additional parts that are attached to, and moveable along with, the basic functional membrane, and wherein the total mass of said one or more additional parts is Ma≥0, wherein the moveable reference membrane comprises (1) the basic reference membrane, and (2) one or more additional parts that are attached to, and moveable along with, the basic reference membrane, and wherein the total mass of said one or more additional parts is Ma≥0, and wherein the hole density HD is in the range of from X to Y, and X and Y satisfy the following equations:

$$X=(-6.47\times10^{-5})+(3.30\times10^{-6})(Ao)^{-1/3}+(-1.21\times10^{-4})(Ma/Mo)^{2/3},\text{ and}$$

$$Y=(-2.91\times10^{-3})+(8.08\times10^{-5})(Ao)^{-1/3}+(-2.35\times10^{-3})(Ma/Mo)^{2/3}.$$

4. The capacitive microphone according to claim 3, wherein X is from 0.015% to 0.059%, and Y is from to 0.303% to 1.322%.

5. The capacitive microphone according to claim 1, wherein, the moveable functional membrane comprises (1) the basic functional membrane with a mass of Mo>0 and area of Ao square meters ($m^2$), and (2) one or more additional parts that are attached to, and moveable along with, the basic functional membrane, and wherein the total mass of said one or more additional parts is Ma≥0;

wherein the moveable reference membrane comprises (1) the basic reference membrane, and (2) one or more additional parts that are attached to, and moveable along with, the basic reference membrane, and wherein the total mass of said one or more additional parts is Ma≥0, and wherein the hole density HD is in the range of from X to Y, and X and Y satisfy the following equations:

$$X=(-7.64\times10^{-5})+(3.86\times10^{-6})(Ao)^{-1/3}+(4.41\times10^{-4})(Ma/Mo)^{2/3},\text{ and}$$

$$Y=(-1.98\times10^{-3})+(5.40\times10^{-5})(Ao)^{-1/3}+(-1.57\times10^{-3})(Ma/Mo)^{2/3}.$$

6. The capacitive microphone according to claim 5, wherein X is from 0.017% to 0.069%, and Y is from to 0.199% to 0.88%.

7. The capacitive microphone according to claim 1, wherein the moveable functional membrane comprises (1) the basic functional membrane with a mass of Mo>0 and area of Ao square meters ($m^2$), and (2) one or more additional parts that are attached to, and moveable along with, the basic functional membrane, and wherein the total mass of said one or more additional parts is Ma≥0;

wherein the moveable reference membrane comprises (1) the basic reference membrane, and (2) one or more additional parts that are attached to, and moveable along with, the basic reference membrane, and wherein the total mass of said one or more additional parts is Ma≥0, and wherein the hole density HD is in the range of from X to Y, and X and Y satisfy the following equations:

$$X=(-8.65\times10^{-5})+(4.35\times10^{-6})(Ao)^{-1/3}+(-1.59\times10^{-4})(Ma/Mo)^{2/3};\text{ and}$$

$$Y=(-1.37\times10^{-3})+(3.96\times10^{-5})(Ao)^{-1/3}+(-1.18\times10^{-3})(Ma/Mo)^{2/3}.$$

8. The capacitive microphone according to claim 7, wherein X is from 0.019% to 0.078%, and Y is from to 0.152% to 0.655%.

9. The capacitive microphone according to claim 1, wherein the moveable functional membrane comprises (1) the basic functional membrane with a mass of Mo>0 and area of Ao square meters ($m^2$), and (2) one or more additional parts that are attached to, and moveable along with, the basic functional membrane, and wherein the total mass of said one or more additional parts is Ma≥0;

wherein the moveable reference membrane comprises (1) the basic reference membrane, and (2) one or more additional parts that are attached to, and moveable along with, the basic reference membrane, and wherein the total mass of said one or more additional parts is Ma≥0, and wherein the hole density HD is in the range of from X to Y, and X and Y satisfy the following equations:

$$X=(-9.53\times10^{-5})+(4.81\times10^{-})(Ao)^{-1/3}+(-1.76\times10^{-4})(Ma/Mo)^{2/3},\text{ and}$$

$$Y=(-1.09\times10^{-3})+(3.15\times10^{-5})(Ao)^{-1/3}+(-9.47\times10^{-4})(Ma/Mo)^{2/3}.$$

10. The capacitive microphone according to claim 9, wherein X is from 0.021% to 0.086%, and Y is from to 0.119% to 0.52%.

11. The capacitive microphone according to claim 1, wherein the moveable functional membrane comprises (1) the basic functional membrane with a mass of Mo>0 and area of Ao square meters ($m^2$), and (2) one or more additional parts that are attached to, and moveable along with, the basic functional membrane, and wherein the total mass of said one or more additional parts is Ma≥0;

wherein the moveable reference membrane comprises (1) the basic reference membrane, and (2) one or more additional parts that are attached to, and moveable along with, the basic reference membrane, and wherein the total mass of said one or more additional parts is Ma≥0, and wherein the hole density HD is in the range of from X to Y, and X and Y satisfy the following equations:

$$X=(-1.11\times10^{-4})+(6.23\times10^{-6})(Ao)^{-1/3}(-2.27\times10^{-4})(Ma/Mo)^{2/3},\text{ and}$$

$$Y=(-4.44\times10^{4})+(1.70\times10^{-5})(Ao)^{-1/3}+(-5.74\times10^{-4})(Ma/Mo)^{2/3}.$$

12. The capacitive microphone according to claim 11, wherein X is from 0.029% to 0.113%, and Y is from to 0.071% to 0.295%.

13. The capacitive microphone according to claim 1, which is a MEMS microphone.

14. The capacitive microphone according to claim 1, which is a parallel capacitive microphone.

15. The capacitive microphone according to claim 1, which is a lateral mode capacitive microphone.

16. The capacitive microphone according to claim 15, comprising a first electrical working conductor, a second electrical working conductor, and a motional sensor;

wherein said two working conductors are configured to have a relative spatial relationship therebetween, and a mutual capacitance exists between said two working conductors, wherein an acoustic pressure impacting upon one or two of said two working conductors along a range of impacting directions in 3D space can cause a variation Va of said mutual capacitance, an acceleration of the capacitive microphone can cause a variation Vm of said mutual capacitance as a noise, and Vtotal=Va+Vm, wherein said variation Va reaches its maximal value when a given acoustic pressure impacts upon one or two of said two working conductors along one direction among said range of impacting directions, said one direction being defined as the primary working direction;

wherein the first electrical working conductor has a first working projection along said primary working direction on a conceptual working plane that is perpendicular to said primary working direction, and the second electrical working conductor has a second working projection along said primary working direction on the conceptual working plane, wherein the first working projection and the second working projection have a shortest working distance Dwmin therebetween, and Dwmin remains greater than zero regardless of that one or two of said two working conductors is (are) impacted by an acoustic pressure along said primary working direction or not;

wherein the motional sensor has a capacitance output Vms, which is used to compensate Vtotal in real-time;

wherein the motional sensor includes a first electrical reference conductor, and a second electrical reference conductor, wherein said two reference conductors are configured to have a relative spatial relationship therebetween, and a mutual capacitance exists between said two reference conductors;

wherein said acoustic pressure can also impact upon one or two of said two reference conductors along a range of impacting directions in 3D space and can cause a variation Va' of said mutual capacitance, said acceleration of the capacitive microphone can also cause a variation Vm' of said mutual capacitance, and Vms=Va'+Vm';

wherein a corrected output Vet=Vtotal−Vms;

wherein said variation Va' reaches its maximal value when a given acoustic pressure impacts upon one or two of said two reference conductors along one direction among said range of impacting directions, said one direction being defined as the primary reference direction;

wherein the first electrical reference conductor has a first reference projection along said primary reference direction on a conceptual reference plane that is perpendicular to said primary reference direction, and the second electrical reference conductor has a second reference projection along said primary reference direction on the conceptual reference plane;

wherein the first reference projection and the second reference projection have a shortest distance Drmin therebetween, and Drmin remains greater than zero regardless of that one or two of said two reference conductors is (are) impacted by an acoustic pressure along said primary reference direction or not;

wherein the first electrical working conductor and the first electrical reference conductor are identical, and are fixed relative to a substrate;

wherein the second electrical working conductor comprises a working membrane that is movable relative to the substrate, and said primary working direction is perpendicular to the working membrane plane;

wherein the second electrical reference conductor comprises a reference membrane that is movable relative to the substrate, and said primary reference direction is perpendicular to the reference membrane plane;

wherein the working membrane plane and the reference membrane plane are in parallel with each other;

wherein the second electrical working conductor and the second electrical reference conductor are identical except that the reference membrane has less air resistance than the working membrane;

wherein the reference membrane has one or more openings thereon for air ventilation, but the working membrane does not;

wherein the capacitive microphone further comprises a working air flow restrictor that restricts the flow rate of air that flows in/out of the gap between the working membrane and the substrate, and a reference air flow restrictor that restricts the flow rate of air that flows in/out of the gap between the reference membrane and the substrate; and wherein the working air flow restrictor comprises a working insert into a working trench, and the reference air flow restrictor comprises a reference insert into a reference trench.

17. The capacitive microphone according to claim 16, wherein Va'<20% Va, and 80% Vm<Vm'<Vm.

18. The capacitive microphone according to claim 16, wherein the first electrical working conductor, the second electrical working conductor, the first electrical reference conductor, and the second electrical reference conductor are independently of each other made of polysilicon, gold, silver, nickel, aluminum, copper, chromium, titanium, tungsten, or platinum.

19. The capacitive microphone according to claim 16, wherein the movable working, membrane is attached to the substrate via three or more working suspensions such as four working suspensions; the movable reference membrane is attached to the substrate via three or more reference suspensions such as four reference suspensions; and the working suspensions and the reference suspensions are identical.

* * * * *